US008496520B2

(12) United States Patent
Nicely et al.

(10) Patent No.: US 8,496,520 B2
(45) **Date of Patent: *Jul. 30, 2013**

(54) GAMING SYSTEM AND METHOD CONFIGURED TO CHANGE THE ODDS OF A PLAYER OBTAINING A WINNING GAME OUTCOME OR A DESIGNATED GAME OUTCOME FOR A PLAY OF A GAME WITHOUT CHANGING THE PAYTABLE OF THE GAME

(75) Inventors: Mark C. Nicely, Daly City, CA (US); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/431,690

(22) Filed: Mar. 27, 2012

(65) Prior Publication Data

US 2012/0184361 A1 Jul. 19, 2012

Related U.S. Application Data

(63) Continuation of application No. 11/864,417, filed on Sep. 28, 2007, now Pat. No. 8,162,746.

(51) Int. Cl.
*A63F 9/24* (2006.01)

(52) U.S. Cl.
USPC ..... 463/20

(58) Field of Classification Search
USPC ..... 463/20
See application file for complete search history.

(56) References Cited

U.S. PATENT DOCUMENTS

| | | | |
|---|---|---|---|
| 4,582,324 | A | 4/1986 | Koza et al. |
| 4,991,848 | A | 2/1991 | Greenwood et al. |
| 5,116,055 | A | 5/1992 | Tracy |
| 5,123,649 | A | 6/1992 | Tiberio |
| 5,178,390 | A | 1/1993 | Okada |
| 5,280,909 | A | 1/1994 | Tracy |
| 5,286,023 | A | 2/1994 | Wood |
| 5,344,144 | A | 9/1994 | Canon |
| 5,380,007 | A | 1/1995 | Travis et al. |
| 5,524,888 | A | 6/1996 | Heidel |

(Continued)

FOREIGN PATENT DOCUMENTS

| | | |
|---|---|---|
| AU | 199747626 | 6/1998 |
| AU | 199858216 | 8/1998 |

(Continued)

OTHER PUBLICATIONS

All That Glitters Article, written by Strictly Slots, published in Dec. 2004.

(Continued)

*Primary Examiner* — Corbett B Coburn
(74) *Attorney, Agent, or Firm* — Neal, Gerber & Eisenberg LLP

(57) ABSTRACT

A gaming system and method that enables the odds of obtaining a winning outcome or a designated outcome for a play of a game to change without modifying the paytable of the game. The gaming system makes a first determination using a first processor based on a paytable of a game. The gaming system makes a second determination using a second processor, where the second determination may be based, at least in part, on the wager amount. The gaming system displays a single game outcome to the player and either provides the player with the highest award resulting from the determinations or any awards resulting from the determinations.

34 Claims, 11 Drawing Sheets

U.S. PATENT DOCUMENTS

| | | | |
|---|---|---|---|
| 5,536,016 | A | 7/1996 | Thompson |
| 5,542,669 | A | 8/1996 | Charron et al. |
| 5,551,692 | A | 9/1996 | Pettit et al. |
| 5,611,730 | A | 3/1997 | Weiss |
| 5,645,486 | A | 7/1997 | Nagao et al. |
| 5,655,961 | A | 8/1997 | Acres et al. |
| 5,702,304 | A | 12/1997 | Acres et al. |
| 5,709,603 | A | 1/1998 | Kaye |
| 5,711,525 | A | 1/1998 | Breeding |
| 5,741,882 | A | 4/1998 | Acres et al. |
| 5,752,882 | A | 5/1998 | Acres et al. |
| 5,766,076 | A | 6/1998 | Pease et al. |
| 5,788,573 | A | 8/1998 | Baerlocher |
| 5,807,172 | A | 9/1998 | Piechowiak |
| 5,820,459 | A | 10/1998 | Acres et al. |
| 5,833,538 | A | 11/1998 | Weiss |
| 5,836,817 | A | 11/1998 | Acres et al. |
| 5,855,515 | A | 1/1999 | Pease et al. |
| 5,868,619 | A | 2/1999 | Wood et al. |
| 5,876,284 | A | 3/1999 | Acres et al. |
| 5,885,158 | A | 3/1999 | Torango et al. |
| 5,902,048 | A | 5/1999 | Bennett et al. |
| 5,910,048 | A | 6/1999 | Feinberg |
| 5,941,773 | A | 8/1999 | Harlick |
| 5,947,820 | A | 9/1999 | Morro et al. |
| 5,967,894 | A | 10/1999 | Kinoshita et al. |
| 5,980,384 | A | 11/1999 | Barrie |
| 5,989,121 | A | 11/1999 | Sakamoto |
| 5,997,401 | A | 12/1999 | Crawford |
| 6,012,982 | A | 1/2000 | Piechowiak et al. |
| 6,032,955 | A | 3/2000 | Luciano et al. |
| 6,033,307 | A | 3/2000 | Vancura |
| 6,059,289 | A | 5/2000 | Vancura |
| 6,062,980 | A | 5/2000 | Luciano |
| 6,110,041 | A | 8/2000 | Walker et al. |
| 6,110,043 | A | 8/2000 | Olsen |
| 6,117,012 | A | 9/2000 | McCrea, Jr. |
| 6,129,632 | A | 10/2000 | Luciano |
| 6,146,273 | A | 11/2000 | Olsen |
| 6,155,925 | A | 12/2000 | Giobbi et al. |
| 6,159,097 | A | 12/2000 | Gura |
| 6,159,098 | A | 12/2000 | Slominary et al. |
| 6,162,122 | A | 12/2000 | Acres et al. |
| 6,176,233 | B1 | 1/2001 | Sunaga et al. |
| 6,186,894 | B1 | 2/2001 | Mayeroff |
| 6,203,429 | B1 | 3/2001 | Demar et al. |
| 6,213,877 | B1 | 4/2001 | Walker et al. |
| 6,224,483 | B1 | 5/2001 | Mayeroff |
| 6,231,442 | B1 | 5/2001 | Mayeroff |
| 6,231,445 | B1 | 5/2001 | Acres et al. |
| 6,241,608 | B1 | 6/2001 | Torango |
| 6,244,957 | B1 | 6/2001 | Walker et al. |
| 6,244,958 | B1 | 6/2001 | Acres |
| 6,295,337 | B1 | 9/2001 | Therenin et al. |
| 6,315,289 | B1 | 11/2001 | Sakamoto et al. |
| 6,322,445 | B1 | 11/2001 | Miller |
| 6,334,612 | B1 | 1/2002 | Wurz et al. |
| 6,358,147 | B1 | 3/2002 | Jaffe |
| 6,375,569 | B1 | 4/2002 | Acres |
| 6,435,968 | B1 | 8/2002 | Torango |
| RE37,885 | E | 10/2002 | Acres et al. |
| 6,468,156 | B1 | 10/2002 | Hughs-Baird et al. |
| 6,592,460 | B2 | 7/2003 | Torango |
| 6,599,193 | B2 | 7/2003 | Baerlocher et al. |
| 6,626,758 | B1 | 9/2003 | Parham |
| 6,656,048 | B2 | 12/2003 | Olsen |
| 6,712,695 | B2 | 3/2004 | Mothwurf et al. |
| 6,726,564 | B2 | 4/2004 | Hogan et al. |
| 6,726,565 | B2 | 4/2004 | Hughs-Baird |
| 6,869,357 | B2 | 3/2005 | Adams et al. |
| RE38,812 | E | 10/2005 | Acres et al. |
| 7,029,395 | B1 | 4/2006 | Baerlocher |
| 7,077,746 | B2 | 7/2006 | Torango |
| 7,108,603 | B2 | 9/2006 | Olive |
| 7,357,144 | B2 | 4/2008 | Tessmer et al. |
| 7,455,586 | B2 | 11/2008 | Nguyen et al. |
| 2002/0042297 | A1 | 4/2002 | Torango |
| 2003/0060266 | A1 | 3/2003 | Baerlocher |
| 2003/0060279 | A1 | 3/2003 | Torango |
| 2003/0069068 | A1 | 4/2003 | Kaminkow |
| 2003/0181231 | A1 | 9/2003 | Vancura et al. |
| 2003/0216166 | A1 | 11/2003 | Baerlocher et al. |
| 2004/0009811 | A1 | 1/2004 | Torango |
| 2004/0048644 | A1 | 3/2004 | Gerrard et al. |
| 2004/0063492 | A1 | 4/2004 | Baerlocher et al. |
| 2004/0183256 | A1 | 9/2004 | Ko |
| 2005/0054429 | A1 | 3/2005 | Baerlocher et al. |
| 2005/0060050 | A1 | 3/2005 | Baerlocher |
| 2005/0096123 | A1 | 5/2005 | Cregan et al. |
| 2005/0119047 | A1 | 6/2005 | Olive |
| 2005/0143168 | A1 | 6/2005 | Torango |
| 2005/0176488 | A1 | 8/2005 | Olive |
| 2005/0209004 | A1 | 9/2005 | Torango |
| 2005/0239542 | A1 | 10/2005 | Olsen |
| 2005/0282625 | A1 | 12/2005 | Nicely |
| 2006/0030399 | A1 | 2/2006 | Baerlocher |
| 2006/0030403 | A1 | 2/2006 | Lafky et al. |
| 2006/0040721 | A1 | 2/2006 | Cuddy et al. |
| 2006/0040723 | A1 | 2/2006 | Baerlocher et al. |
| 2006/0040732 | A1 | 2/2006 | Baerlocher et al. |
| 2006/0040733 | A1 | 2/2006 | Baerlocher et al. |
| 2006/0040734 | A1 | 2/2006 | Baerlocher et al. |
| 2006/0040736 | A1 | 2/2006 | Baerlocher et al. |
| 2006/0063584 | A1 | 3/2006 | Brill et al. |
| 2006/0087082 | A1 | 4/2006 | Ko |
| 2006/0128457 | A1 | 6/2006 | Cannon |
| 2006/0183535 | A1 | 8/2006 | Marks et al. |
| 2007/0026923 | A1 | 2/2007 | Muir |
| 2007/0054726 | A1 | 3/2007 | Muir et al. |
| 2007/0054733 | A1 | 3/2007 | Baerlocher |
| 2007/0054738 | A1 | 3/2007 | Muir |
| 2007/0060271 | A1 | 3/2007 | Cregan et al. |
| 2007/0060292 | A1 | 3/2007 | Peterson |
| 2007/0060314 | A1 | 3/2007 | Baerlocher et al. |
| 2007/0060321 | A1 | 3/2007 | Vasquez et al. |
| 2007/0099696 | A1 | 5/2007 | Nguyen et al. |
| 2007/0105619 | A1 | 5/2007 | Kniesteadt et al. |
| 2007/0184887 | A1 | 8/2007 | Cannon |
| 2007/0191088 | A1 | 8/2007 | Breckner et al. |
| 2007/0218975 | A1 | 9/2007 | Iddings et al. |
| 2007/0218982 | A1 | 9/2007 | Baerlocher |
| 2007/0298874 | A1 | 12/2007 | Baerlocher et al. |
| 2007/0298875 | A1 | 12/2007 | Baerlocher et al. |
| 2009/0061996 | A1 | 3/2009 | Walker et al. |

FOREIGN PATENT DOCUMENTS

| | | |
|---|---|---|
| AU | 199881994 | 2/1999 |
| AU | 199884162 | 3/1999 |
| WO | WO 00/32286 | 6/2000 |

OTHER PUBLICATIONS

Ancient Chinese Secret Video Slots Advertisement, written by IGT, published in 2006.

Aristocrat Technologies et al. v. International Game Technology et al. Answer and Counterclaims of Defendants—Case No. 3:06-cv-03714-MJJ, pp. 24-29, filed Jun. 16, 2006.

Aristocrat Buyer's Guide with Aces Advertisement, 2 pages, published Mar.-May 1989.

Aristocrat Buyer's Guide with Aces Advertisement, 3 pages, published Jun.-Aug. 1989.

Cash Express Advertisement, written by Aristocrat Leisure Industries Pty. Ltd., published prior to Sep. 28, 2007.

Double The Price Is Right Slots Article [online] [retrieved on Jan. 21, 2008, available prior to Sep. 28, 2007]. Retrieved from the Internet at <URL: http://www.igt.com>.

Hot Hot Penny Series Game Description [online] [retrieved on Jan. 21, 2008, available prior to Sep. 28, 2007.] Retrieved from the Internet at <URL: http://www.videoslotmachines.com>.

Jackpot Bingo Description [online] [retrieved on Apr. 12, 2001]. Retrieved from the Internet at <URL: http://www.csds.com>.

Jackpot Hunter Mystery Progressives Advertisement, written by IGT, published in 2005.

Jackpot Hunter Mystery Progressives Article [online] [retrieved on Jan. 21, 2008, available prior to Sep. 28, 2007]. Retrieved from the Internet at <URL: http://www.igt.com>.

MegaJackpots World's Largest Advertisement, written by IGT, published in 1998.
MegaJackpots Advertisement, written by IGT, published in 2006.
Poker Machine Specification Section A, written by Ainsworth Nominees PTY. LTD., published prior to Jun. 6, 2005.
Powerball Odds & Prizes Game Description [online] [retrieved on Jul. 11, 2002]. Retrieved from the Internet at <URL: http://www.musl.com>.
Proprietary Information of the Ainsworth Group of Companies, written by Ainsworth Nominees PTY. LTD, published in 1989.
Slot Machines A Pictorial History of the First 100 Years, Fifth Edition, pp. 19, 30-34, 43, 85-88 and 213, written by Marshall Fey, published in 1997.
Slots Review: Fair's Fortune, All that Glitters, Fistful of Dollars—Wild Shot Article [online] [retrieved on Sep. 4, 2007, available prior to Jun. 6, 2005]. Retrieved from the Internet at <URL: http://mitchell.casinocitytimes.com>.
Soul Train Mystery Progressives Advertisement, written by IGT, published in 2006.
Strictly Slots Magazine [online] [retrieved on in Sep. 2005]. Retrieved from the Internet at <URL: http://www.strictlyslots.com>.
The Dating Game Article, written by Strictly Slots, published in Aug. 2004.
The Price is Right Fort Knox Mystery Progressives Advertisement, written by IGT, published in 2006.
Wheel of Fortune Video Advertisement, written by IGT, published in 1999.
Zeus Game Description [online] [retrieved on Jan. 18, 2008, available prior to Sep. 28, 2007]. Retrieved from the Internet at <URL: http://www.wms.com>.

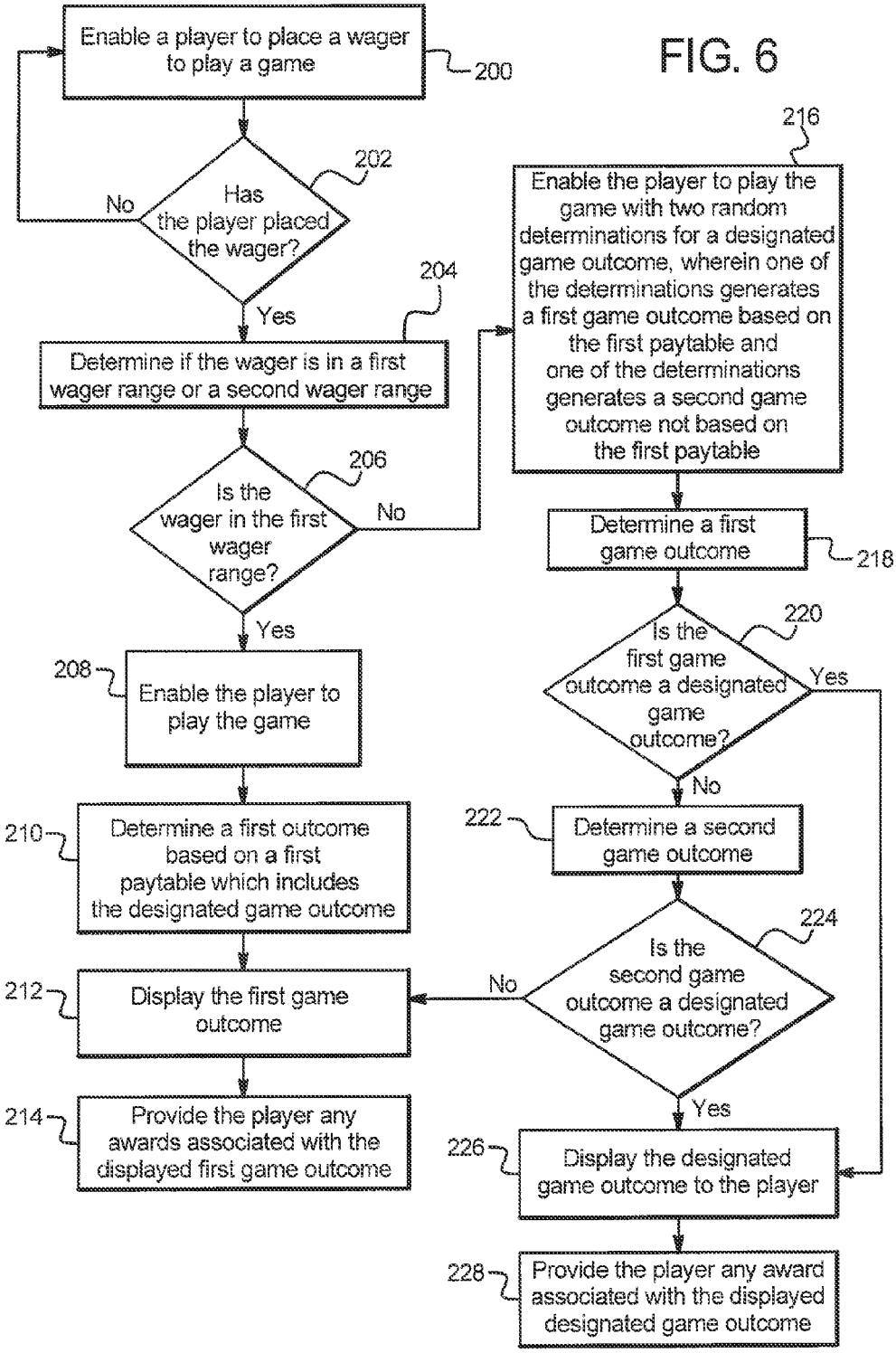
FIG. 6
Enable a player to place a wager to play a game
200
Has the player placed the wager?
202
No
Yes
Determine if the wager is in a first wager range or a second wager range
204
Is the wager in the first wager range?
206
No
Yes
Enable the player to play the game
208
Determine a first outcome based on a first paytable which includes the designated game outcome
210
Display the first game outcome
212
Provide the player any awards associated with the displayed first game outcome
214
Enable the player to play the game with two random determinations for a designated game outcome, wherein one of the determinations generates a first game outcome based on the first paytable and one of the determinations generates a second game outcome not based on the first paytable
216
Determine a first game outcome
218
Is the first game outcome a designated game outcome?
220
Yes
No
Determine a second game outcome
222
Is the second game outcome a designated game outcome?
224
No
Yes
Display the designated game outcome to the player
226
Provide the player any award associated with the displayed designated game outcome
228

GAMING SYSTEM AND METHOD CONFIGURED TO CHANGE THE ODDS OF A PLAYER OBTAINING A WINNING GAME OUTCOME OR A DESIGNATED GAME OUTCOME FOR A PLAY OF A GAME WITHOUT CHANGING THE PAYTABLE OF THE GAME

PRIORITY CLAIM

This application is a continuation of, and claims priority to and the benefit of, U.S. patent application Ser. No. 11/864,417, filed on Sep. 28, 2007, the entire contents of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game.

In such known gaming machines, the amount of the wager made on the primary game by the player may vary. For instance, the gaming machine may enable the player to wager a minimum number of credits, such as one credit (e.g., one cent, nickel, dime, quarter or dollar) up to a maximum number of credits, such as five credits. This wager may be made by the player a single time or multiple times in a single play of the primary game. For instance, a slot game may have one or more paylines and the slot game enables the player to make a wager on each payline in a single play of the primary game. Thus, it is known that a gaming machine, such as a slot game, enables players to make wagers of substantially different amounts on each play of the primary or base games.

In many of these gaming machines, the award is based on the player obtaining a winning symbol or symbol combination and on the amount of the wager. For example, when a player wagers multiple credits on a single payline and the player obtains a winning symbol combination on that payline, a win amount is typically based on the number of credits wagered on that payline. That is, the respective part of the paytable for that payline is chosen or determined based on the player's wager amount. Therefore, in many instances, as a player's wager increases, the amount a player can win increases. Symbols or symbol combinations that are less likely to occur usually provide higher awards.

For certain designated awards, players do not receive a higher award when they wager more. That is, the designated awards are not scaled to match the player's wager. For example, certain designated awards and prizes, such as physical awards (e.g., a motorcycle or boat), have a value that does not change based on the amount wagered by a player. These designated awards do not have to be predetermined and may increase, based on suitable incrementing factors, as is known in progressive awards. However, regardless of how much a player wagers, if they win the award, the player receives the value of the designated award and the paytable is not based on the amount wagered. For example, if the player wagers one credit on a game to win a jackpot award of $100,000 and wins, the player wins $100,000 for the one wagered credit. If the player wagers ten credits on a game to win a jackpot award of $100,000 and wins, the player wins $100,000 for ten wagered credits, or $10,000 per credit. The player who wagers more than the minimum required wager to be eligible for the award is in one sense at a disadvantage. This problem is compounded when gaming machines or games of different wager denominations are linked to offer the same designated award. In such circumstances, players who wager at gaming machines or on games with a higher wager denomination are wagering more to obtain a same designated award as someone who may be wagering less, at a lower wager denomination gaming machine or game.

In certain instances, instead of going to a casino, a player plays games at a gaming establishment website. On-line gaming enables games to be played using different types of currencies to play for one or more designated awards. Certain players with a less favorable exchange rate may be dissuaded from playing for an as is award or a designated award if they have to wager more to try to win the designated award than other players without an increased chance of winning the designated award and without an enhanced designated award. Additionally, on-line gaming frequently offers a greater range of wager denominations. Players playing for an as is award may also be discouraged from wagering with the higher wager denominations because they do not receive a benefit from such higher wagers.

An additional issue regarding these problems is that gaming machines typically include memory devices that store game programs. A processor of the gaming machine typically runs the stored game program to provide the game. Each of these game programs has a predetermined approved paytable. One known way to change the probability that a player will win an award is by changing one or more paytables of the game. Another known way to change the probability that a player will win an award in a slot game is by changing the quantities and/or types of the symbols on the reels or the probabilities associated with such symbols. In general, gaming establishments are not able to readily change game programs to have new paytables or vary the number or types of symbols and save the new program in the memory device of the gaming machine. Presently, if a gaming establishment wants to change the payback of a game, it must typically select from amongst a set of preloaded models or it must obtain and load a new mode of the game program.

Additionally, most gaming terminal play in a gaming establishment occurs in the context of a regulatory environment in which there is substantial cost and/or delay involved in obtaining approval for certain new types of base game programs. That is, for a gaming device manufacturer to provide a gaming establishment a game program to provide to a player that game program must have obtained regulatory approval. To obtain regulatory approval, a regulatory body must have approved the operation of the game program, including but not limited to, approving the paytable or prize structure, and the overall payback percentage. However, because the paytables are set for the games, the gaming establishment cannot easily change the odds of winning a designated award for players with larger wagers without changing the base game model.

Thus, there is a continuing need to provide new and different gaming machines and gaming systems as well as new and different ways to increase the probability of winning one or more designated awards for players.

SUMMARY

The gaming system and method of the present disclosure provides a way for gaming establishments to increase the probability of one or more players obtaining a winning game outcome in a play of a game relative to a size of a qualifying wager without changing the paytable of the base game. In one embodiment, the gaming system provides multiple independent random determinations for a play of the game when the player wagers above a certain or designated threshold or level. The first random determination is based on a paytable of the game and the second random determination is not based on the paytable of the game.

More specifically, in one embodiment, the gaming system provides a game having a first paytable. Paytable, as used herein, includes the symbols and symbol combinations which can occur in the game, the probabilities of generating such symbols and symbol combinations, and the awards associated with the generation of such symbols and symbol combinations. As used herein, pay schedule includes the winning symbols and symbol combinations and their respective awards. Upon placement of a wager on a play of the game, a first processor of the gaming system makes a first determination to randomly determine a game outcome for the player based on this paytable. In one embodiment, if the player's wager meets certain criteria, a second processor of the gaming system makes a second, separate random determination or a supplemental determination. In different embodiments, the probability of winning this second determination is based on an amount of the wager.

In one embodiment, if an award resulting from the second determination is higher than an award resulting from the first determination, the gaming system substitutes the higher award resulting from the second determination for any award that would have been provided resulting from the first determination. In another embodiment, the gaming system provides the award resulting from the second determination and/or in addition to any awards resulting from the first determination to the player. That is, in alternative embodiments, upon winning in a second determination or in both of the determinations, the gaming system either substitutes an award resulting from the second determination for any award that would have been provided to a player from the paytable or provides the player an award that was not determined based on the paytable of the base game in addition to any award determined based on the paytable of the game.

In certain embodiments, the gaming system only provides the player with a single game outcome, such as a single combination of symbols. The single combination of symbols may include multiple wins or losses, such as results from multiple paylines. However, the gaming system does not provide the player with a first game outcome and a second game outcome. In one embodiment, in a play of the game where a first determined game outcome is based on a first paytable and a second determined game outcome is not based on the first paytable but is based on a second paytable are associated with different award amounts, the game outcome displayed to the player corresponds to the game outcome associated with the highest award amount. In a play of the game where a first determined game outcome based on a first paytable and a second determined game outcome based on the second paytable are associated with equal award amounts, the game outcome displayed to the player corresponds to at least one of the first game outcome and/or the second game outcome. However, a single game outcome is displayed to the player.

In certain of such embodiments, the average expected payback percentage remains constant by linearly increasing the odds of winning the second determination with the wager amount without modifying the paytable of the base game. In one embodiment, the gaming system provides players who placed higher wagers a higher probability of obtaining a winning outcome in the game relative to players who made lower wagers. Providing a second separate chance of winning facilitates a gaming system that provides a game via a gaming machine or via on-line delivery to maintain the average expected payback percentage for a player while changing the odds of obtaining a winning game outcome for a play of a game without changing the predetermined math model of the game.

For example, a video slot game includes three reels, each with 256 stop positions where each stop position has an equal probability of being generated. The first reel has two top award symbols with a 2/256 chance of being generated. The second reel has two top award symbols with a 2/256 chance of being generated. The third reel has one top award symbols with a 1/256 chance of being generated. Therefore, the overall probability of generating a top award symbol combination on a single payline is $2\times2\times1/(256\times256\times256)$ which equals 1/4,194,304. If there are three paylines there is a 3/4,194,304 chance of generating a top award symbol combination. These odds stay the same regardless of the wager. However, in one embodiment, a second determination is made based on the player's wager. For example, the first determination evaluates one payline and the second determination evaluates another payline. This second evaluation doubles the chance of obtaining a winning outcome without changing the reel strips of the primary game. It should be appreciated that in certain embodiments, the outcomes of both determinations are not displayed to the player. In one embodiment, the second determination is not displayed to the player. For example, the second determination can change the odds of obtaining a winning outcome by changing the combination of top award symbols on the reels and making a separate random determination based on the changed reel strips while the first determination is based on the unchanged reel strips. The second determination may be based on completely different symbols than the first determination or any other suitable determination that does not correspond to the first determination. In one embodiment, the second determination is only made once the player's overall probability of winning exceeds the probability provided by the primary game, such as the probability of generating a designated symbol on the payline for each of the reels. Once the player's odds exceed 1/4,194,304, the gaming device then alters the probability of winning the second determination. In one embodiment, the gaming device alters the second determination such that the overall probability of winning increases incrementally with the wager.

In one embodiment, the gaming system makes the second determination for every play of the game. In one embodiment, the gaming system enables the player wagering a small wager amount to have a chance of obtaining a winning game outcome from the second determination. At the same time, the gaming system increases the likelihood of obtaining a winning game outcome from the second determination as the player increases the total bet or wager or an individual component of the wager. Therefore, in one embodiment, a probability associated with a first determination is a set probability and the probability associated with the second determination is a variable probability. In one embodiment, this variable probability increases with the wager amount, such that the overall probability of winning increases linearly with the wager amount.

In another embodiment, the gaming system only makes the second determination when the player's wager is in a certain range or above a certain level for the play of the game. In either embodiment, the probability of winning the second determination may be set or changed based on any suitable factor. In one embodiment, the gaming system changes the probabilities of winning the second determination as the amount of the player's wager changes. The gaming system provides players with higher wagers a higher probability of winning. That is, a player betting less money needs to play the game more times, on average, to obtain a winning game outcome from the second determination. Likewise, a player betting more money needs to play the game less times, on average, to obtain a winning game outcome from the second determination. Therefore, players playing for a designated award with a paytable that does not change based on the wager are not penalized or disadvantaged for wagering more than the minimum required amount for the designated award. The wagers may be based on different credit denominations and different currencies. In different embodiments, the probability of winning the second determination changes based on the denominations and the currencies to equalize the overall odds of winning based on the amount of the wager.

In one embodiment, the gaming system simultaneously makes the first determination and the second determination. In another embodiment, the gaming system sequentially makes the first determination and the second determination. In one embodiment, the gaming system makes the second determination, if the determination is that the player does not obtain a winning game outcome or a designated game outcome from the second determination, the gaming system then makes the first determination. In another embodiment, if the gaming system determines to provide the player an award or a designated award as a result of the first determination, the game is over and the gaming system provides the player the award or the designated award without determining and/or evaluating a second determination. In one embodiment, different processors or controllers determine the first determination and the second determination. It should be appreciated that one or both of these processors or controllers may be located remotely from one or more gaming machines or home computers.

In one embodiment, the gaming system includes different wager ranges. In one such embodiment, if the player wagers an amount in a first wager range, the player has a first probability of winning and a first number of random determinations. If the player wagers an amount in a second higher wager range, the player has a second probability of winning and a second number of random determinations. For example, if the player wagers an amount in the first wager range, the player has the chance of obtaining a winning game outcome or a designated game outcome from a first determination. If the player wagers an amount in the second wager range, the player has the chance of obtaining a winning game outcome or a designated game outcome from the first determination. If the player does not obtain the winning game outcome or the designated game outcome from the first determination, the gaming system makes another random determination based on a second probability of obtaining the winning game outcome or the designated game outcome to provide the player another chance to obtain the winning game outcome or the designated game outcome. Thus, in one embodiment, the player has a better chance of obtaining the winning or designated game outcome if the player wagers an amount in the second higher wager range.

In one embodiment, the average expected payback percentage remains the same whether or not the player wagers an amount in the second higher wager range but the player has better overall odds of winning for that play of the game.

In one embodiment, the probability of obtaining a designated game outcome from the first determination is lower than the combined probability of obtaining a designated game outcome from the first determination and the second determination. In one embodiment, the second determination is based on a probability that varies with the wager. For example, if the wager amount is in the second wager range, the gaming system determines the second probability based on the wager amount. As the player wagers more, the second probability increases. The gaming system then makes the second determination based on the second probability. Therefore, in one embodiment, if a player wagers a first amount, the player has the first probability of winning. In one embodiment, if the player wagers a second amount, the player has the first probability of winning in addition to a second probability of winning, providing a higher overall probability of winning to the player.

In another embodiment, the gaming system includes a plurality of different designated awards or designated game outcomes, such as multi-level progressive awards. In one such embodiment, the gaming system determines the probability of winning one, a plurality or each of the designated awards or designated results is based on the amount wagered. In another embodiment, the player may only qualify to win certain of the designated awards or designated game outcomes based on the amount of the wager. The probabilities of winning each of the designated awards or designated results may individually vary with the amount wagered.

It should be appreciated that the designated game outcomes may be any suitable game outcomes and may be associated with any suitable designated awards including but not limited to progressive awards, jackpot awards or a physical award or prize.

It should be appreciated that the second probability of winning for the player may increase or decrease based on any suitable factors. It should be appreciated that one or more probabilities of winning may increase with the wager in any suitable manner. In one embodiment, the probability of winning the second determination or the overall probability of winning increases linearly with the wager amount. In one embodiment, the probability of winning the second determination or the overall probability of winning increases faster than the wager amount. In another embodiment, if the player wagers under a certain wager amount, the gaming system does not change the probability of winning the second determination for that player or the overall probability of winning.

The gaming system may provide the player any suitable numbers of determinations to win any suitable awards based on any suitable factors.

It should be appreciated that the gaming system and method of the present disclosure enables a gaming establishment to change an overall probability of obtaining a winning game outcome for a play of a game for a player based on any suitable reason without changing the base game math model or requiring a library of base game choices. For example, if the award is a large award, the gaming establishment can decrease the odds of winning the award. If the award is a smaller award, the gaming establishment can increase the odds of winning the award or cause the smaller award to be won more frequently. In one embodiment, the gaming establishment increases the probability of winning a second determination for all players in increments. In certain embodiments, the gaming establishment therefore increases the chance of winning one or more awards of a game's paytable and/or alters the probability of winning one or more the awards not included in the game's paytable based on a determination that is separate from the paytable. Therefore, the designated math model of the base game remains intact while still changing the overall probability of winning for the player. Therefore, a player can increase their chances of winning one or more awards, such as progressive awards and as is awards such as physical awards, encouraging players to wager more.

Accordingly, one embodiment of the gaming system disclosed herein provides the gaming establishment the flexibility to change the overall odds of winning a play of a game of a gaming system without changing the math model of the base game or the average expected payback percentage for the play of the overall game. In one embodiment, the gaming system changes the overall odds of obtaining a winning game outcome for a play of a game based on the amount wagered by a player. In one embodiment, the gaming system provides the player a designated number of chances to win a designated award based on the wager amount. Accordingly, in another embodiment, the gaming system provides the player the opportunity to win different designated awards based on the amount wagered.

Additional features and advantages are described herein, and will be apparent from, the following Detailed Description and the figures.

BRIEF DESCRIPTION OF THE FIGURES

FIG. 6 is a flow chart of one method of one embodiment of the present disclosure illustrating different wager ranges being associated with different numbers of determinations and providing the player the highest won award.

DETAILED DESCRIPTION

The present disclosure may be implemented in various configurations for gaming machines, gaming devices or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
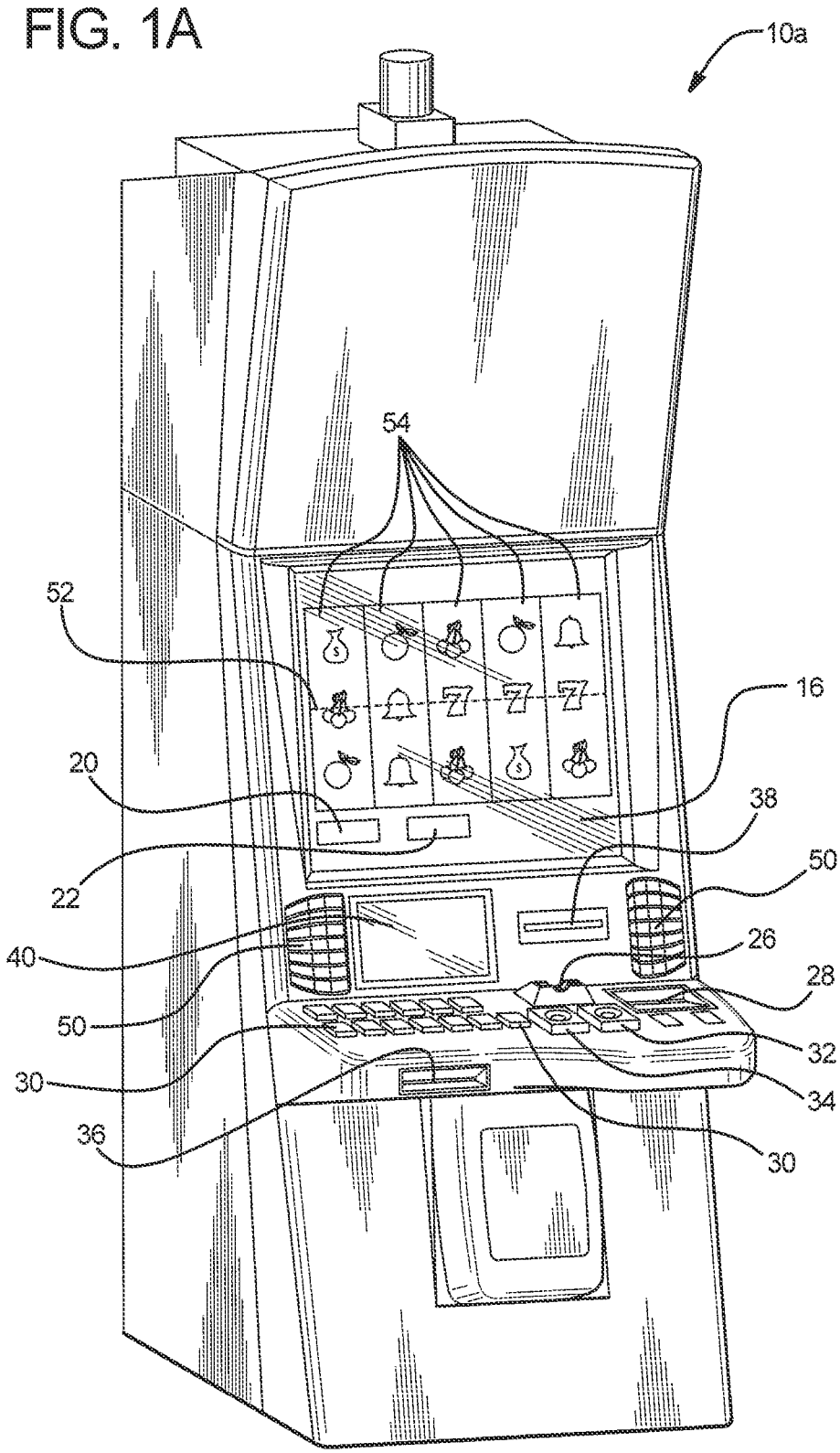
FIGS. 1A and 1B are front perspective views of alternative embodiments of gaming devices disclosed herein.
Figure 1B:
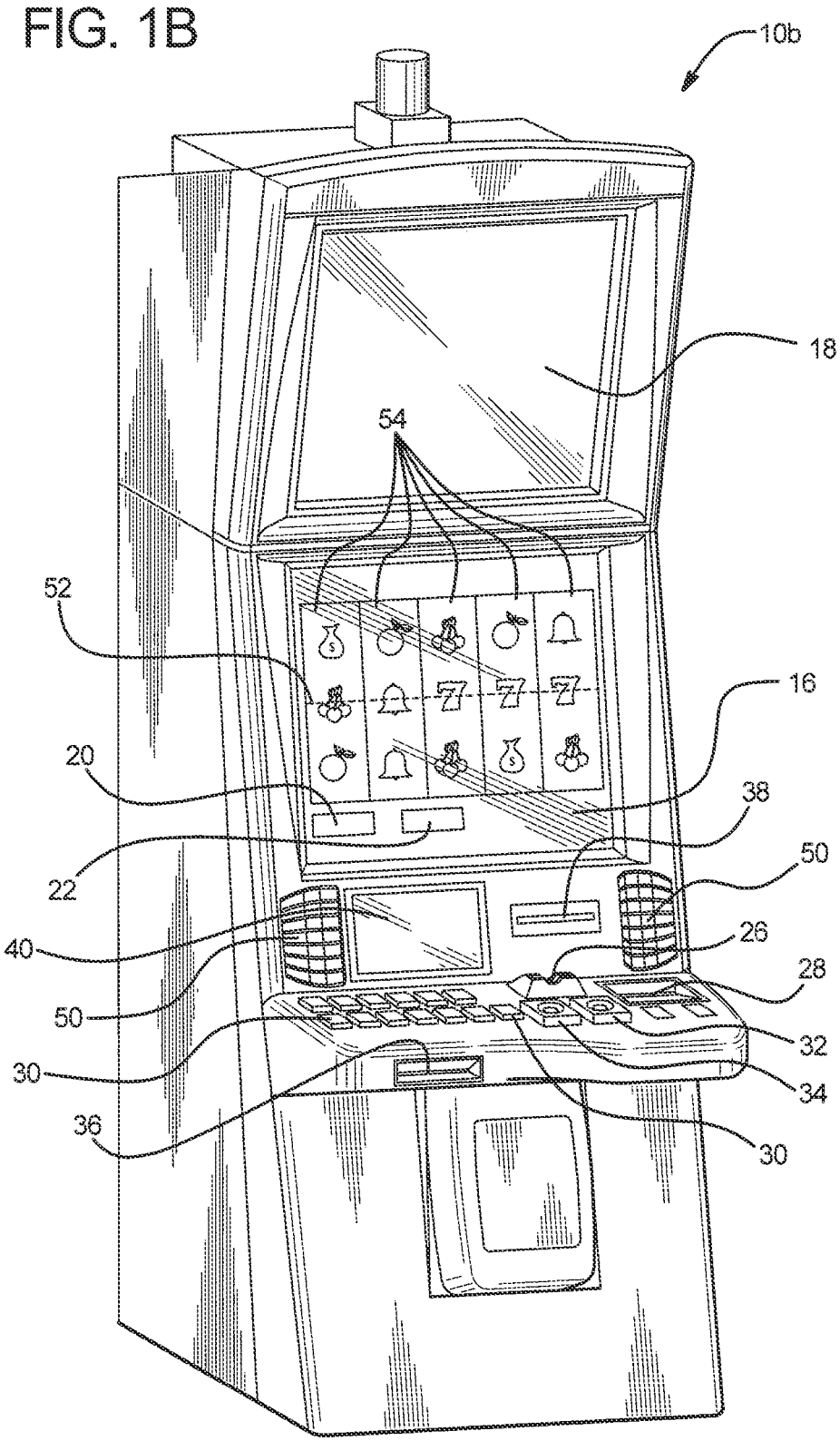

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
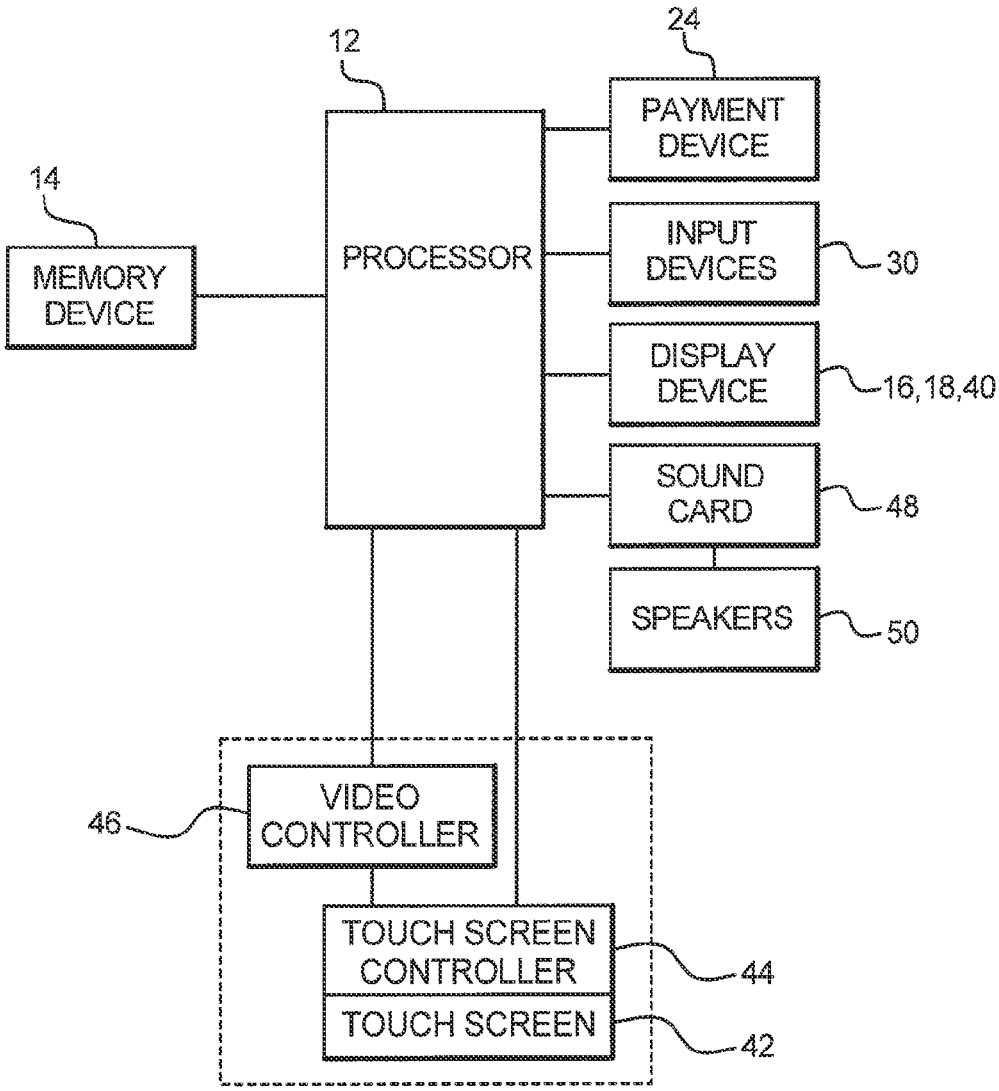
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment, each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
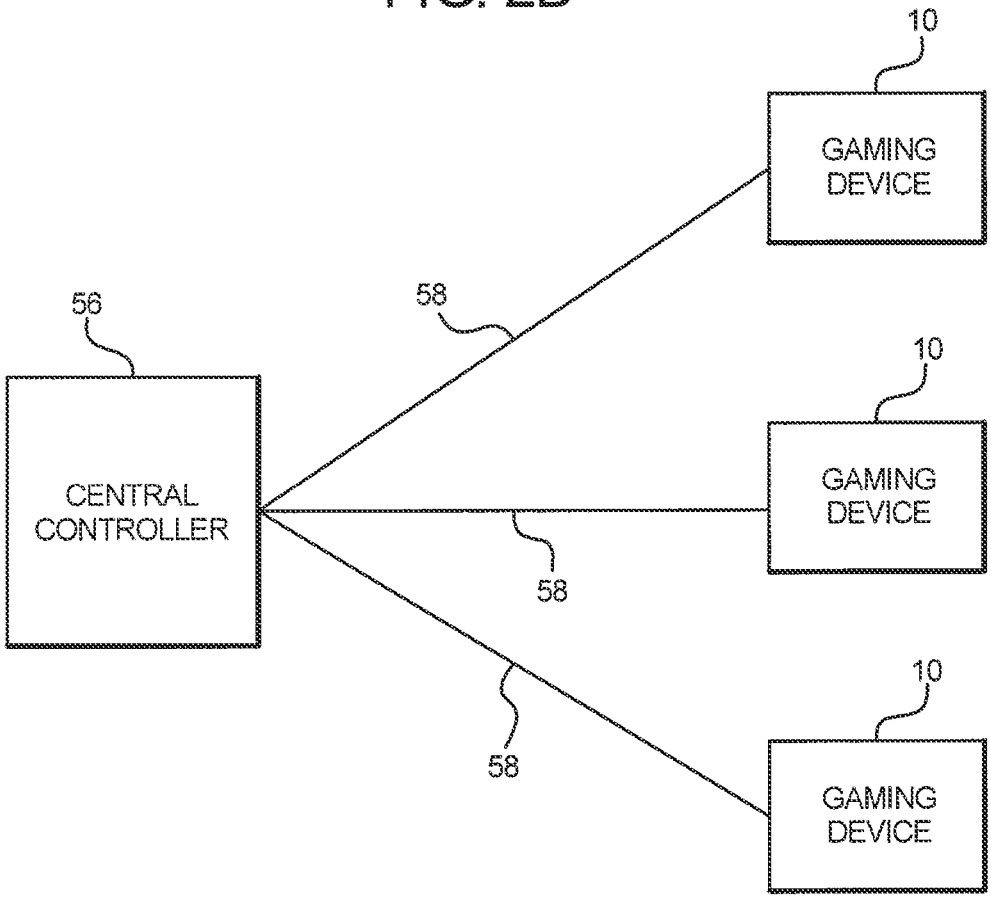
FIG. 2B is a schematic diagram of the central server in communication with a plurality of gaming devices in accordance with one embodiment of the gaming system disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

Certain progressive systems are set up such that each stand alone gaming device associated with a designated progressive award (or each bank of gaming machines associated with a designated progressive award) has its own separate progressive controller which tracks and maintains the designated progressive award. In one method or model of tracking and maintaining a progressive award, the gaming device itself keeps track of the progressive metering (i.e., how much of a wager placed to allocate to a designated progressive award). In this method, the gaming device does not communicate with a progressive server, but functions as a stand-alone gaming system.

Another method of tracking and maintaining a progressive award includes the gaming device sending coin-in information to a designated progressive controller and the designated progressive controller using this information to track or maintain the progressive award. In one embodiment, the gaming system is a server based gaming system. In different methods, the gaming machine sends either a delta number (i.e., a change since the last coin-in sent) to the designated progressive controller or the actual current coin-in to the designated progressive controller (wherein the central server determines any change in the coin-in by comparing the actual current coin-in to any previous coin-in). Utilizing this communicated information (in either form), the designated progressive controller determines the change in coin-in from the previous communication with the gaming device and sets each progressive level to be incremented an appropriate amount.

Another method of tracking and maintaining a progressive award includes a gaming device sending a pulse to a designated progressive controller for each wager or coin placed at the gaming device. In this method, each gaming device is associated with its own progressive tracking meter and the progressive controller is not aware of any of the information tracked by the gaming device's progressive tracking meter (i.e., the progressive controller only recognizes a pulse sent from the gaming device.)

In certain progressive award systems, each gaming machine associated with a designated progressive award is proximate to or otherwise associated with the progressive controller which maintains the designated progressive award, (such that the gaming machine and the progressive controller communicate with each other to establish the progressive award). In certain systems, if a gaming system operator desires to add or otherwise associate another gaming machine (or bank of gaming machines) with the designated progressive award, the gaming system operator must cause the additional gaming machine (or additional bank of gaming machines) to communicate with the designated progressive controller.

In one gaming device or gaming system, a progressive award is formed by allocating a percentage of a player's wager into the player's own progressive award or pool (i.e., a personal progressive award) and subsequently returning the player's progressive award or pool to the player upon the occurrence of an event.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Changing the Odds of a Player Obtaining a Winning Game Outcome or a Designated Game Outcome for a Play of a Game without Changing the Paytable of the Game The present disclosure can be implemented in a variety of different ways. In one embodiment, the gaming system makes a second determination for each play of the game. That is, in one embodiment, even if the player's wager does not exceed a certain level or is not in a certain range, the gaming system makes the second determination for each play of the game. The probability of obtaining a winning game outcome or a designated game outcome for the second determination may or may not change based on the amount of the wager. In another embodiment, the gaming system only makes the second determination when the player meets criteria for a play of the game, such as wagering at least a designated amount. That is, in one embodiment, if the player wagers the minimum wager level, the gaming system does not make the second determination. Thus, the probability of obtaining a winning game outcome for the second determination may or may not change based on the amount of the wager.

In one embodiment, the gaming system only provides the player with the highest award won. That is, in this single award or substitution embodiment, the gaming system evaluates the value associated with a first game outcome based on the first determination and the value associated with a second game outcome based on the second determination. The gaming system only displays the game outcome to the player associated with the highest value and provides the player the award of the highest value. In another embodiment, the gaming system provides the player any award won from the second game outcome in addition to any award won from the first game outcome. In this additional award embodiment, the gaming system may provide the player with a plurality of awards.

In one embodiment, one or more same awards may be provided as a result of the first game outcome and the second game outcome. That is, a player can win a same award as a result of the determination based on the first paytable and as a result of the determination not based on the first paytable. In another embodiment, the second determination may result in a game outcome not available from a first paytable. The determination(s) not based on the first paytable may be associated with a single award or multiple available awards.

It should be appreciated that any of the above-listed embodiments may be combined in any suitable manner.

Figure 3:
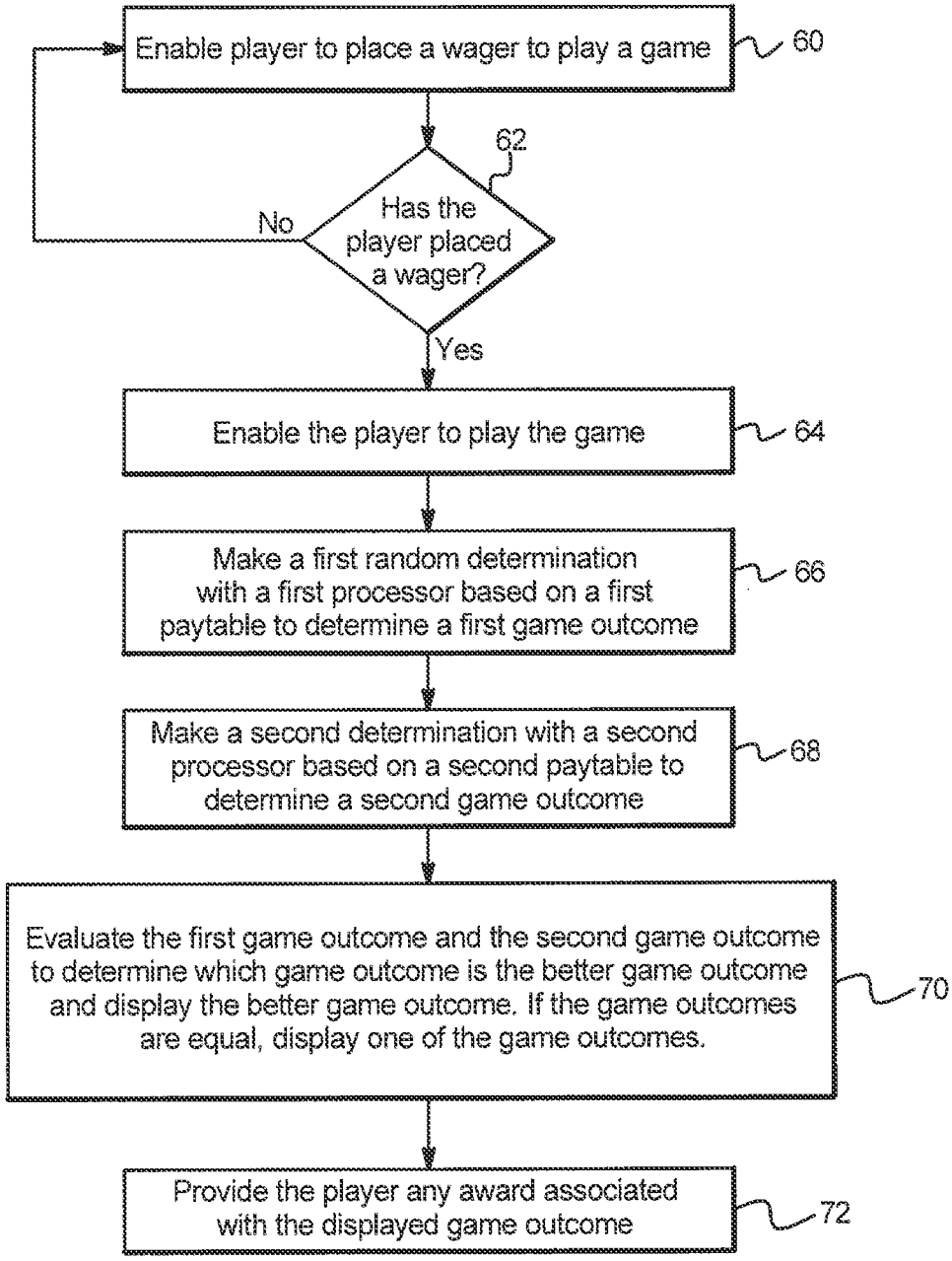
FIG. 3 is a flow chart illustrating one method of one embodiment of providing a player with the highest determined award determined by multiple separate determinations.

As illustrated in FIG. 3, in one embodiment, the gaming system makes the second determination regardless of the wager amount and determines which determination has the highest award or the best game outcome and substitutes that game outcome for any other determined game outcome and provides that game outcome to the player. As illustrated in FIG. 3, in one embodiment, the gaming system enables a player to place a wager to play a game with a as illustrated in block 60. The gaming system determines if the player placed a wager as illustrated in diamond 62. If the player has not placed the wager, the gaming system enables the player to place a wager to play the game as illustrated in block 60. If the player has placed the wager, the gaming system provides a play of the game as illustrated in block 64. In one embodiment, a first processor of the gaming system makes a first random determination based on a first paytable as illustrated in block 66. In one embodiment, the gaming system determines a probability associated with a second determination based on an amount of the wager. In another embodiment, the gaming system determines which probability to base the second determination on based on a second paytable. As illustrated in FIG. 3, the second processor of the gaming system makes a second random determination as illustrated in block 68. In one embodiment, the gaming system determines a game outcome to display as illustrated in block 70. In one embodiment, the gaming system determines which game outcome is a better game outcome. The gaming system determines if the first game outcome or the second game outcome is a better game outcome or corresponds to a higher award value if the game outcomes correspond to different values. If one of the game outcomes is a better game outcome, the gaming system displays that game outcome. If the game outcomes correspond to equal values, the gaming system determines one of the game outcomes to display. That is, in one embodiment, the gaming system makes two separate determinations using two separate processors. In one embodiment, the first determination is based on a first paytable of the game. The math model or the first paytable of the game does not change. In one embodiment, the gaming system makes another determination that is not based on the first paytable of the game. The gaming system displays a game outcome corresponding to the best or highest game outcome if the game outcomes correspond to different values. The gaming system displays a game outcome that corresponds to one of the game outcomes or both of the game outcomes if the game outcomes correspond to equal values. The gaming system provides the player any award associated with the displayed game outcome as illustrated in block 72. The gaming system may change the overall odds of a player winning a play of the game for each game played without changing the paytable of the base game or reel strips of the base game by changing the odds associated with winning a separate or independent determination that is not based on the paytable of the base game.

It should be appreciated that the determinations not based on the base paytable may be made in any suitable manner. In one embodiment, in a single award embodiment, the second determination is a simple determination of whether the player wins a single designated award. That is, in one embodiment, one or more supplemental determinations are not based on a paytable but are random determinations of whether a player wins one or more awards or generates one or more additional game outcomes. In another embodiment, the second award determination is based on a second or supplemental paytable. If determined that the player wins an award based on the second random determination, in one embodiment, the gaming system utilizes a paytable to determine the award or makes another determination to determine the award to provide the player. It should be appreciated that any determination made may include more than one determination or a series of determinations. In another embodiment, the second determination includes a random number generation that corresponds to awards or game outcomes that are associated with awards. For example, available numbers range from 1 to 10,000. Number 1 corresponds to an award of 1,000. Number 2 corresponds to an award of 5,000. Number 3 corresponds to an award of 10,000, and number 4 corresponds to an award of 50,000. Numbers 5 to 10,000 correspond to non-winning game outcomes. If the gaming system generates the numbers 1 to 4, the gaming system provides the player the award corresponding to the number. If the gaming system generates the numbers 5 to 10,000 for the random determination, the gaming system does not provide the player a winning game outcome. The numbers may be weighted in any suitable manner.

Figure 4:
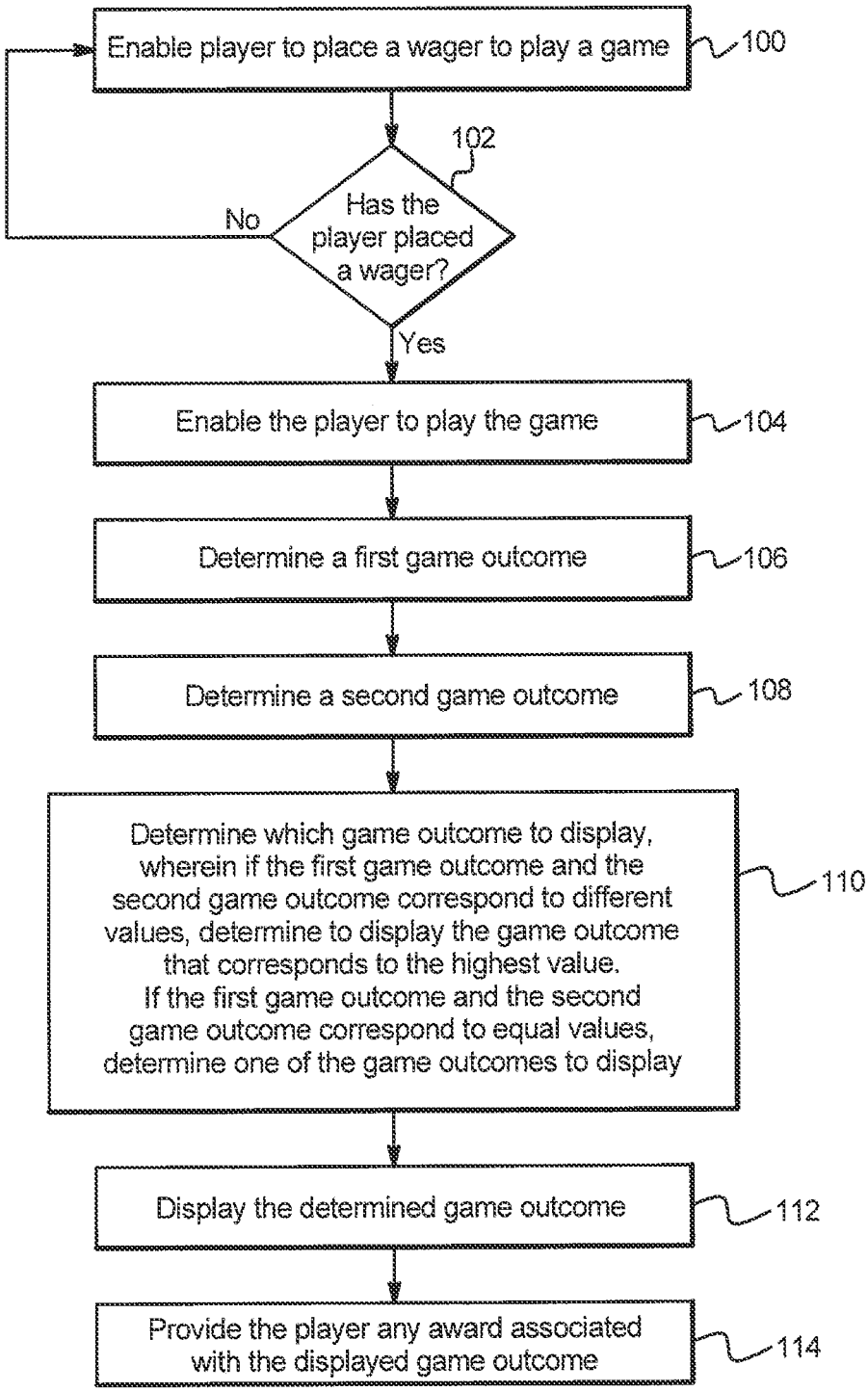
FIG. 4 is a flow chart illustrating one method of one embodiment of determining a game outcome to provide the player determined by a number of different determinations where the highest award is provided to the player.

As illustrated in FIG. 4, in one embodiment, the gaming system determines a first game outcome and a second game outcome separately. The gaming system enables a player to place a wager to play a game as illustrated in block 100. The gaming system determines if the player placed a wager as illustrated in diamond 102. If the player has not placed the wager, the gaming system enables the player to place a wager to play the game on one of the plurality of gaming machines as illustrated in block 100. If the player has placed the wager, the gaming system provides a play of the game as illustrated in block 104. In one embodiment, the gaming system determines a first game outcome based on a first paytable as illustrated in block 106. In one embodiment, the gaming system determines an overall probability of winning a designated award, such as jackpot award, based on an amount of the wager. The gaming system determines a second game outcome as illustrated in block 108.

The gaming system determines which game outcome to display as illustrated in block 110. If the first game outcome and the second game outcome are associated with different values, the gaming system determines to display the game outcome that corresponds to the highest value. For example, if the first game outcome has or is associated with a value of 25 credits and the second game outcome is associated with a designated award of 10,000 credits, the gaming system provides the player the game outcome corresponding to the 10,000 credits. If the first game outcome and the second game outcome are associated with equal values, the gaming system determines a game outcome to display that corresponds to at least one of the game outcomes. In one embodiment, the gaming system displays the determined game outcome as illustrated in block 112. The gaming system provides the player any award associated with the displayed game outcome as illustrated in block 114. Thus, the gaming system may change the overall odds of winning a play of a game on a game-by-game basis without changing the first paytable of the base game by changing the odds associated with winning one or more second determinations based on a second paytable. It should be appreciated that the gaming system may make any suitable number of determinations and each determination may be based on a separate paytable and a plurality or all of the paytables may be different.

In another embodiment, if the player wins the designated award, the gaming system provides the player the designated award in addition to any awards won by the player in the game outcome.

Figure 5A:
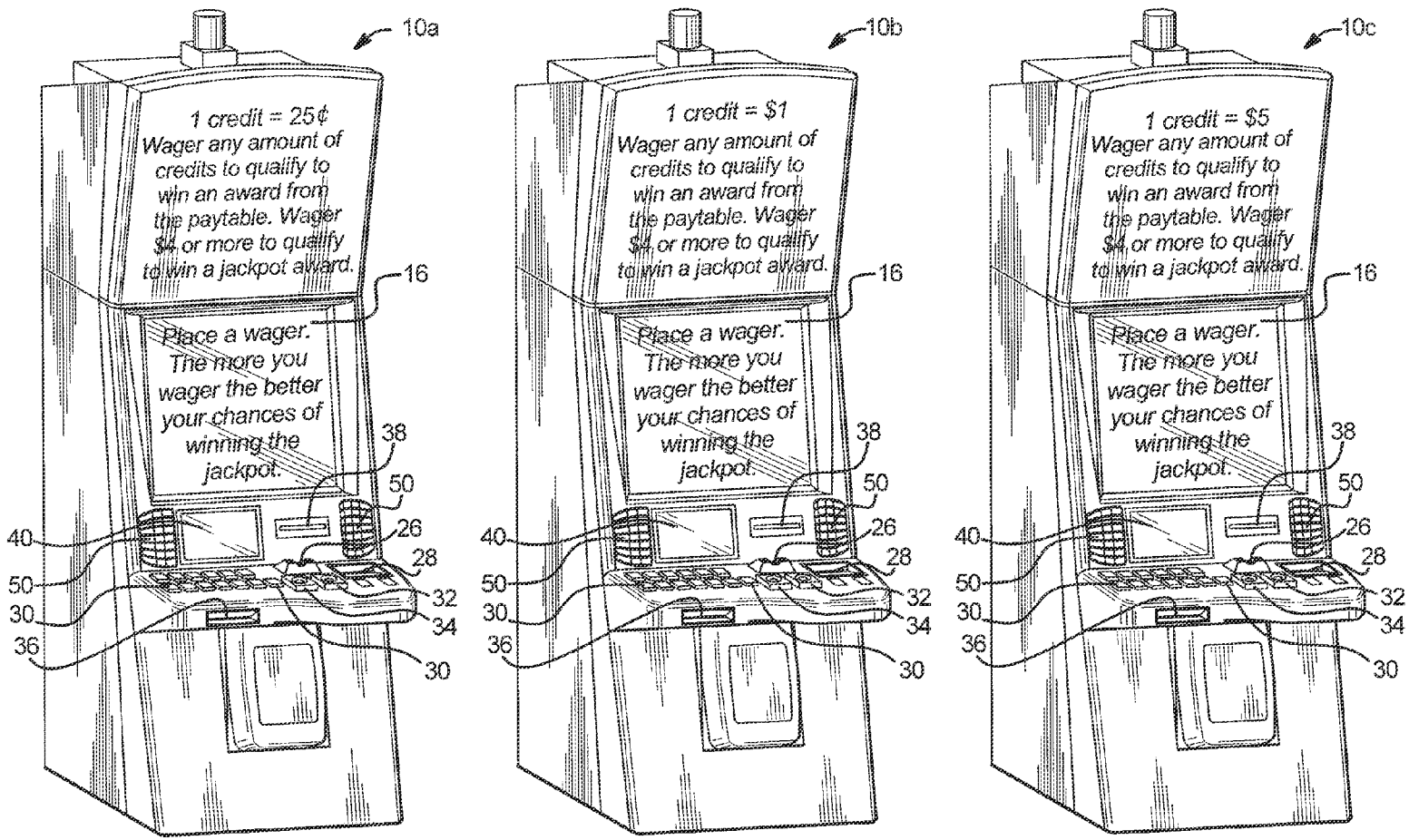
FIGS. 5A to 5C are perspective views of gaming machines of different credit denominations, wherein the gaming system changes the probability of winning a designated award based on the amount the player wagers and determines a game outcome to provide the player based on one or more determinations.
Figure 5B:
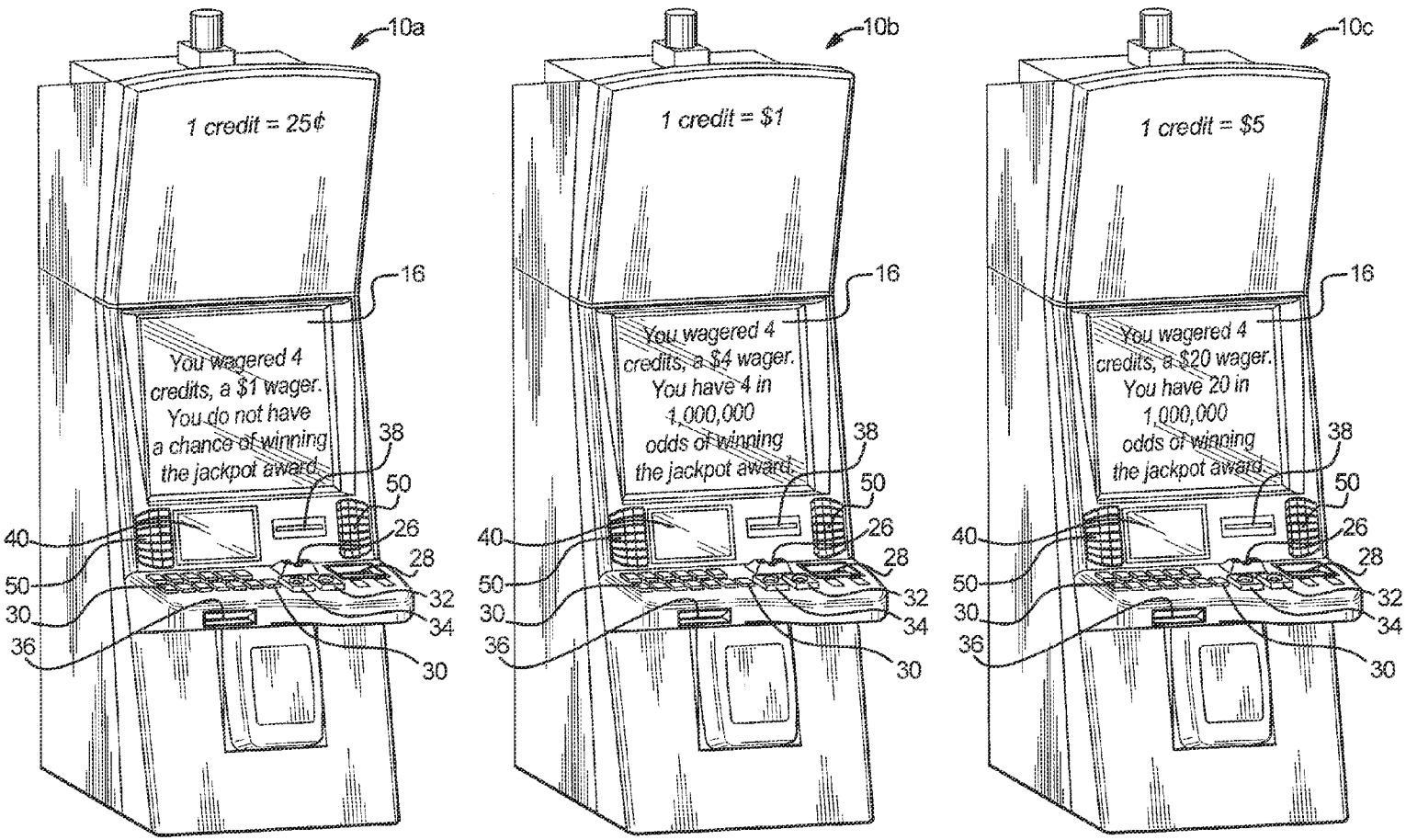
Figure 5C:
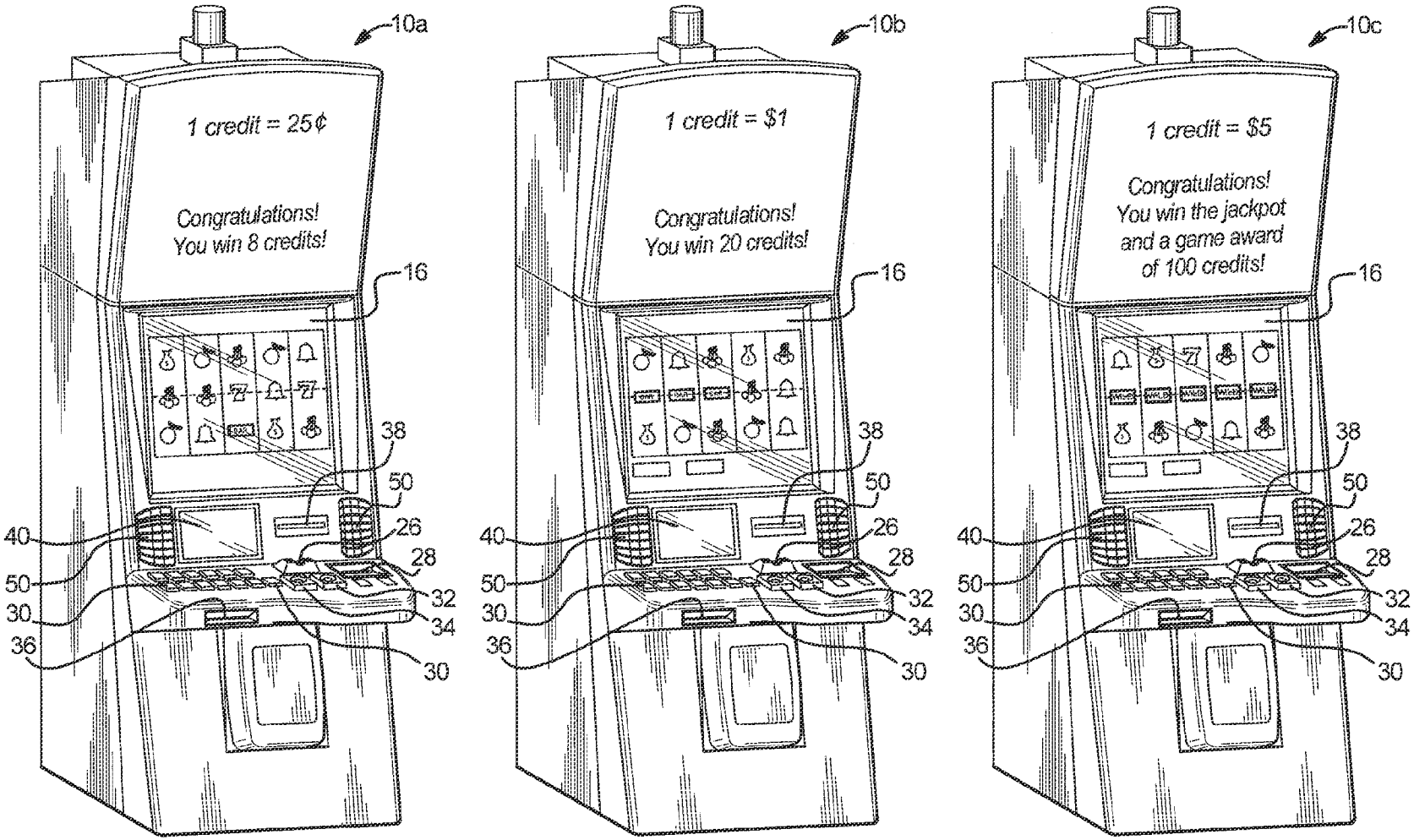

FIGS. 5A to 5C illustrate one embodiment of the gaming system making a second determination for a single, designated award when the player wagers above a certain level where the player receives any determined awards. In the illustrated embodiment, the gaming system changes the probability of winning a single designated award, such as a jackpot award, based on the amount wagered without changing the odds or the paytable of the base game. In the illustrated embodiment, each of the gaming machines 10*a*, 10*b*, and 10*c* has a different credit denomination. The first gaming machine 10*a* has a $0.25 credit denomination. That is, one credit is equal to $0.25. The second gaming machine 10*b* has a $1 credit denomination. The third gaming machine 10*c* has a $5 credit denomination. In the illustrated embodiment, wagering any number of credits qualifies a player to win an award from the paytable of the game. If the player wagers $4 or more the player has a chance to win one or more designated awards in addition to any award won in the game. As the player's wager increases above $4, the player has a better chance of winning the designated award.

In another embodiment, the gaming machines may be of different denominations. In one embodiment, the gaming machines have different qualifying threshold bet amounts for the second determination. For example, on the $0.25 denomination gaming machine, any wager of 4 credits or higher ($1 or higher) is eligible for the second determination. On the $5.00 denomination gaming machine, any wager of 4 credits or higher ($20.00 or higher) would be eligible.

As illustrated in FIG. 5B, players (not illustrated) at each of the gaming machines each wager 4 credits which results in different monetary amounts wagered because of the different credit denominations. The player of the first gaming machine wagers 4 credits which is $1. The gaming system determines that the player does not have a chance of winning the jackpot award based on the $1 wager as illustrated in FIG. 5B. The player of the second gaming machine wagers 4 credits which is $4. The gaming system determines that the player has a 4 in 1,000,000 chance of winning a jackpot award based on the $4 wager. The player of the third gaming machine wagers 4 credits which is $20. The gaming system determines that the player has a 20 in 1,000,000 chance of winning a jackpot award based on the $20 wager. In one embodiment, the gaming system determines a higher probability of winning the jackpot award as the wager increases.

In one embodiment, the gaming system makes two separate random determinations for the second and third gaming machines. The gaming system determines a game outcome based on the paytable and a jackpot award outcome for the second and third gaming machines (not illustrated). As illustrated in FIG. 5C, the gaming system determines a winning game outcome all three gaming machines. The gaming system determines the player of the second gaming machine does not win a designated jackpot award. Therefore, the first two gaming machines display the determined game outcome. For the third gaming machine, the gaming system determines a winning game outcome and a winning jackpot award outcome. As illustrated in FIG. 5C, the third gaming machine displays a game outcome of five wild symbols on the payline. The player wins 100 credits for this symbol combination. In the illustrated embodiment, when the player wins the jackpot award, the gaming system provides the player the jackpot award in addition to any award associated with the determined winning game outcome.

Therefore, in one embodiment, the gaming machine displays a game outcome randomly determined based on the first paytable and informs the player that they win the jackpot award. That is, in one embodiment, the gaming machine only displays a single game outcome to the player. This single game outcome may correspond to a first determination or/and a second determination. If the player wins both determinations, in one embodiment, the gaming machine displays a game outcome corresponding to the first determination and/or the second determination but only displays one game outcome. In one embodiment, if the game outcome only corresponds to one of the winning determinations in an embodiment where a player receives any award won, the gaming system informs the player of any other awards won that do not correspond to the displayed game outcome.

In another embodiment, if the player wins the designated award, such as the jackpot award, via the designated award outcome determination, the gaming system replaces any game award won based on the paytable of the game with one or more designated awards or provides the player the highest award won. The gaming system replaces the game outcome with a designated award outcome when the designated award outcome corresponds to the designated award or corresponds to a higher in value than a value corresponding to a game outcome. It should be appreciated that the gaming system may provide the player the higher award by replacing, one, a plurality or all of the symbols of the first game outcome to display the second game outcome. That is, one or more of the symbols of the first game outcome may be overridden and replaced by a symbol to display the second determination.

It should be appreciated that the gaming system may provide the player one or more awards in any suitable manner. For example, a game includes 20 paylines but second determinations may only be made for a plurality of the paylines, for example 5. Therefore, if the player wagers on all 20 paylines, in one embodiment, the gaming system makes a first symbol determination. The gaming device evaluates each of the 5 paylines and in different embodiments always or sometimes makes a second symbol determination for one, a plurality or each of the symbols on the 5 paylines. If one or more of the second determinations results in a designated game outcome, the gaming system replaces one, a plurality or all of the symbols based on the second determination. The gaming system displays all of the symbols. The gaming system evaluates the other wagered on paylines. In one embodiment, the player may win all awards won from symbol combinations generated on the 20 paylines. In another embodiment, if the gaming system generates the designated game outcome, the player only receives the award associated with the designated game outcome. It should be appreciated that this symbol replacement may cause winning or losing outcomes on other wagered on paylines.

FIG. 6 illustrates one embodiment of providing the player a different number of designated award determinations based on the wager amount, where the gaming system provides the player the highest won wager. As illustrated in FIG. 6, the gaming system enables a player to place a wager as illustrated in block 200. The gaming system determines if the player placed the wager as illustrated in diamond 202. If the player did not place the wager, the gaming system enables the player to place the wager to play the game as illustrated in block 200. If the player does place the wager, the gaming system determines whether the wager is in a first wager range or a second wager range as illustrated in block 204. In one embodiment, the gaming system determines if a wager is above or below a certain threshold. For example, if the minimum wager for a game is $0.25 and the maximum wager for the game is $100, the first wager range includes wagers from $0.25 to $69.99 and the second wager range includes wagers from $70.00 to $100.00. In one embodiment, if the player places wagers in the first wager range, the player has a chance to win a designated award based on a first random determination of a first game outcome in the game based on the first paytable. If the player places wagers in the second wager range, the player has a chance to win the designated award based on more than one random second determination for second game outcomes.

As illustrated in FIG. 6, the gaming system determines if the wager is in the first wager range as illustrated in diamond 206. If the wager is in the first wager range, the gaming system enables the player to play the game with a single random determination that, in one embodiment, may result in the winning of the designated award. The gaming system provides the game to the player as illustrated in block 208. The gaming system determines a first game outcome based on a first paytable as illustrated in block 210. The gaming system displays the first game outcome as illustrated in block 212. The gaming system provides the player any awards associated with the displayed game outcome as illustrated in block 214.

As illustrated in FIG. 6, if the wager is not in the first wager range, in one embodiment, the gaming system enables the player to play the game with two, separate random determinations that may result in the winning of the designated award as illustrated in block 216. In one embodiment, one of the determinations is based on a first paytable, and one of the determinations is a separate random determination that is not is based on the first paytable. In one embodiment, the gaming system determines the first game outcome as illustrated in block 218. If the first game outcome is a not designated game outcome, the gaming system displays the first game outcome that as illustrated in block 212. The gaming system provides the player any awards associated with the displayed game outcome as illustrated in block 214.

The gaming system evaluates the first game outcome to determine if the first game outcome is a designated game outcome as illustrated in diamond 220. If the first game outcome is not a designated game outcome, the gaming system makes another, separate random determination to determine a second game outcome as illustrated by block 222. The gaming system determines if the second game outcome is a designated game outcome for the player as illustrated in diamond 224. If the designated award outcome is not a designated game outcome, the gaming system displays the first game outcome as illustrated in block 212. The gaming system provides the player any awards associated with the displayed game outcome as illustrated in block 214. If determined that the second game outcome is the designated game outcome, the gaming system displays the designated game outcome to the player as illustrated in block 226 and provides the player any award that corresponds to the designated game as illustrated in block 228.

It should be appreciated that the wager ranges may be any suitable ranges of wagers. It should also be appreciated that the gaming system may include any suitable numbers of ranges of wagers. For example, if the player wagers an amount in the first wager range, the gaming system makes a single determination. If the player wagers an amount in the second wager range, the gaming system makes two determinations. If the player wagers an amount in the third wager range, the gaming system makes three determinations. In one embodiment, if the player's wager is in a certain wager range, the player does not have any chance to generate a designated game outcome or to win the designated award or awards not included in the base paytable of the game. For example, the gaming system provides players with wagers in the first wager range a random determination of the game outcome but certain awards cannot be won in the game because they are not included in the first paytable. In another embodiment, the gaming system only provides a limited number of wager ranges, such as two. If the player wagers an amount in the first wager range, the gaming system makes a single determination based on the first paytable. If the player wagers an amount in the second wager range, the gaming system makes the first determination based on the first paytable and the gaming system makes a second determination not based on the first paytable but based, at least in part, on the wager amount. It should be appreciated that any of the game outcomes may be associated with any suitable number of awards.

It should be appreciated that the gaming system may include any suitable number of separate determinations. In one embodiment, the gaming system includes a separate determination for each range of wagers. In one such embodiment, each separate determination is based on a different paytable. In another embodiment, the gaming system includes fewer determinations than wager ranges. In another embodiment, the gaming system includes more determinations than wager ranges.

Figure 7:
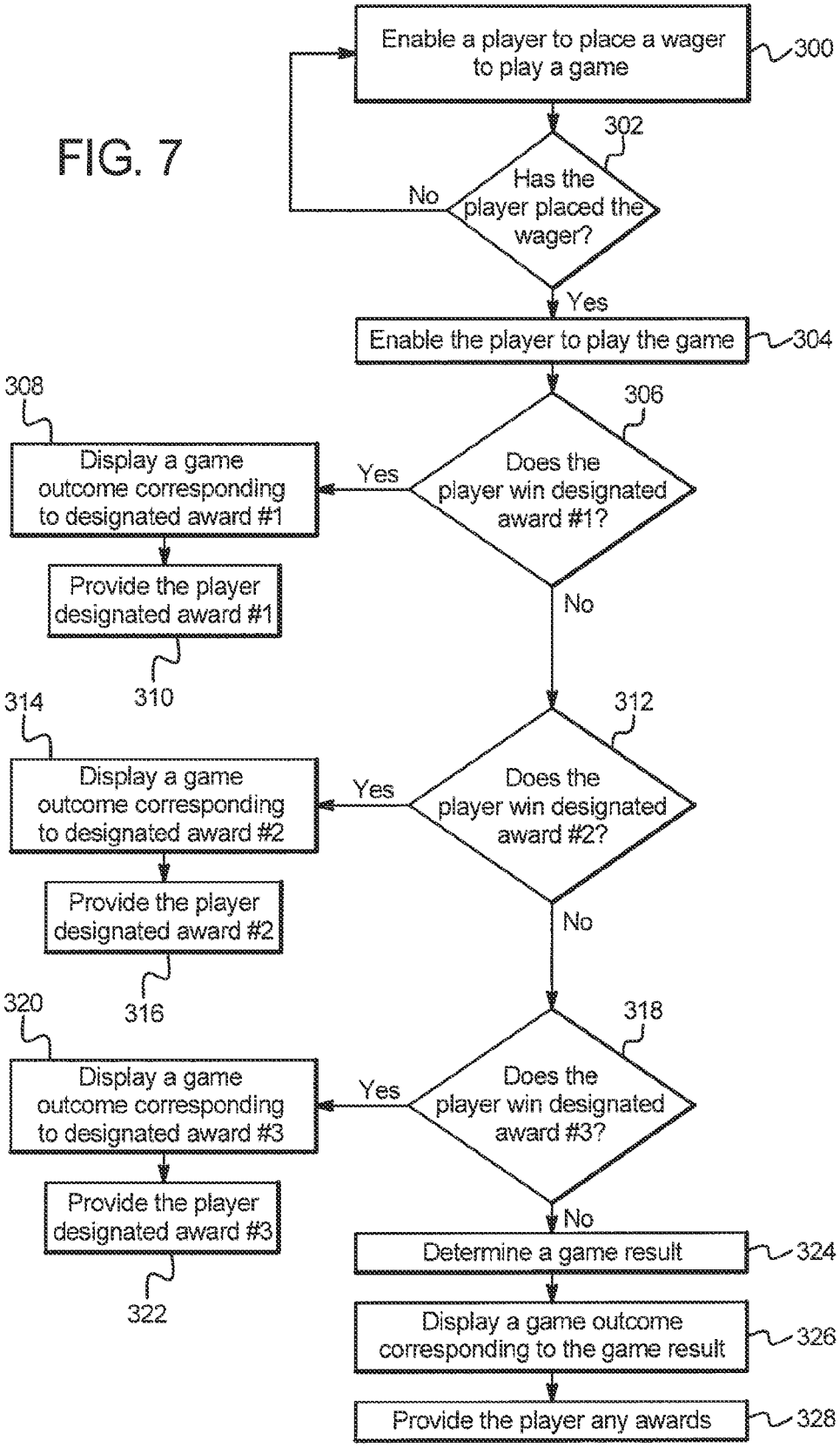
FIG. 7 is a flow chart of one method of one embodiment of the present disclosure illustrating determining whether a player wins one of a plurality of designated awards.

FIG. 7 illustrates one embodiment of a method of determining whether a player wins a plurality of different designated awards. In one embodiment, the designated awards are multi-level progressive awards. As illustrated in FIG. 7, the gaming system enables a player to place a wager to play a game as illustrated by block 300. The gaming system determines if the player placed the wager as illustrated by diamond 302. If the player has not placed a wager, the gaming system enables the player to place the wager to play the game as illustrated by block 300. If the player placed the wager, the gaming system enables the player to play the game as illustrated by block 304. The gaming system randomly determines if the player wins designated award #1 as illustrated by diamond 306. In one embodiment, the determinations of whether a player wins one or more designated awards are not based on the paytable of the game. In one embodiment, the gaming system determines if the player wins the various designated awards based, at least in part, on the amount wagered by the player. If determined that the player wins designated award #1, in one embodiment, the gaming system displays a game outcome to the player corresponding to designated award #1 as illustrated by block 308. The gaming system provides the player designated award #1 as illustrated by block 310. If determined that the player does not win designated award #1, the gaming system randomly determines if the player wins designated award #2 as illustrated by diamond 312. If determined that the player wins designated award #2, the gaming system displays a game outcome to the player corresponding to designated award #2 as illustrated by block 314. The gaming system provides the player designated award #2 as illustrated by block 316. If determined that the player does not win designated award #2, the gaming system randomly determines if the player wins designated award #3 as illustrated by block 318. If determined that the player wins designated award #3, the gaming system displays a game outcome to the player corresponding to designated award #3 as illustrated by block 320. The gaming system provides the player designated award #3 as illustrated by block 322. If determined that the player does not win designated award #3, the gaming system determines a game result for the player as illustrated in block 324. This game result determination is based on the paytable of the game. The gaming system displays a game outcome corresponding to the game result as illustrated by block 326.

The gaming system provides the player any awards associated with the displayed game outcome as illustrated by block 328. It should be appreciated that the gaming system may determine if the player wins any suitable number of awards via a single, secondary determination not based on the paytable of the game.

In one embodiment, the gaming system includes multiple designated awards with different values. In one such embodiment, the gaming system only provides the player the highest valued award that the player wins. In one such embodiment, the gaming system determines if the player wins the highest award first. If the player wins the highest award, the gaming system does not make any further determinations for that game. In another embodiment, the gaming system makes every determination regardless of the results of the other determinations. In another embodiment, the gaming system provides the player any awards that the player wins. For example, the player could win two progressive awards and an award from the game as a result of playing a single game. It should be appreciated that the gaming system may make any determinations in any suitable order.

In the embodiment with the multiple awards available to be won from at least one second determination or a plurality of second determinations, the gaming system may determine the probabilities associated with awards in any suitable manner. For example, the probabilities vary according to the amount of the award. Additionally, in one embodiment, the gaming system changes one or more of the probabilities based on the player's wager. For example, a player with a lower wager may have a lower probability of winning a designated award than a player with a higher wager. In one embodiment, the player must place certain wagers to qualify to win one or more of the designated awards. The gaming system may base the determination of whether or not the player wins one or more designated awards on any suitable factors including but not limited to a wager amount, an average wager amount, a time of day, the award or prize, a player card status, a number of games played, or a location of the gaming machine.

It should be appreciated that the gaming system may change the odds of obtaining a winning game outcome in any suitable manner. For example, in one embodiment, the probability of winning one or more designated awards or a game outcome based on the paytable is a constant probability. That is, the gaming system provides the player the same odds of winning a designated award as a result of the game, such as 1 in 200,000 chance of winning the designated award using the paytable. In one embodiment, the gaming system changes the odds of winning a play of the game based on one or more separate determinations of winning that designated award. For example, if the player's wager qualifies them for a 4 in 200,000 chance to win the designated award, the gaming system makes the first determination which has a 1 in 200,000 chance of winning the designated award. For the second determination, the gaming system determines whether the player wins the designated award based on a 3 in 200,000 chance of winning the designated award. Therefore, the combined probability that the player wins the designated award is 4 in 200,000. This math model easily adapts to gaming machines of different denominations and/or different currencies and to different wager amounts facilitating the probability of winning a designated award without changing the average expected payback percentage and without changing the probabilities of the paytable.

It should be appreciated that the gaming system may change the odds of winning a second determination for any suitable reason and based on any suitable mathematical equation. In one embodiment, the gaming establishment changes the odds of a winning a second determination to change the odds of winning an as is award such that a portion of the wagers funds the award. For example, the base game is a five reel video slot game with a single center payline. Each of the reels includes 30 symbol positions. To win a designated award, for example a car worth $100,000, the gaming system must select reel positions which result in a star symbol on the payline for each of the five reels. In one embodiment, each symbol position has a same chance of being generated on the center payline. The odds of a player of receiving the winning symbol combination and winning the car is (30 symbol positions on the first reel/1 star symbol position on the first reel)×(30 symbol positions on the second reel/1 star symbol position on the second reel)×(30 symbol positions on the third reel/1 star symbol position on the third reel)×(30 symbol positions on the fourth reel/1 star symbol position on the fourth reel)×(30 symbol positions on the fifth reel/1 star symbol position on the fifth reel). Therefore, the player has a 1 in 24.3 million chance of obtaining the star-star-star-star-star symbol combination on the center payline and winning the car.

If this game has a denomination of $1 and the player can only wager 1 credit, and the gaming establishment wants to use 1% of each wager to fund the car, for each credit bet 1 cent would go towards covering the cost of the car. Therefore, the gaming establishment would cover the cost of the car after the play of 10,000,000 games (100,000/0.01). The preferred odds of winning the car for the gaming establishment would be 10 million to 1 to cover the cost of the car. The gaming establishment therefore can change the odds of winning the car based on the second determination while leaving the original reel strips intact. For example, the probability of winning the second determination equals ((the desired probability)−(the probability of winning the car on the first determination))/(1−the probability of winning the car on the first determination). Therefore, in this embodiment, the probability of winning the car via the second determination equals (1/10,000,000−1/24,300,000)/(1−1/24,300,000)=(1/16,993,006). Therefore, in this example, the second probability of winning the second determination is 1/16,993,006 if the gaming establishment funds the car. This formula determines the odds for winning the second determination such that the probabilities of winning the first determination and not the second determination, winning the second determination and not the first determination and winning both the first and second determinations all add up to the desired overall probability of winning. Specifically, the designated prize is awarded if the first determination is a winning determination or if the first determination does not a winning determination but a second determination is a winning determination. The formula for determining the second determination as stated above can be derived as follows: probability of winning the designated award=(probability of winning first determination)+(probability of not winning the first determination)×(probability of winning the second determination). The probability of not winning the first determination can be expressed as (1−probability of not winning the first determination. Therefore, the formula can be written as ((the desired probability)−(the probability of winning the car on the first determination))/(1−the probability of winning the car on the first determination).

In the above-example, in one embodiment, the gaming system randomly determines a reel stop position for each of the five reels. In one embodiment, the gaming system randomly selects a value, N, between 1 and 16,993,006 inclusively either sequentially or in parallel to randomly determining the reel stop positions. In one embodiment, if each of the randomly selected reel stop positions corresponds to a star on the center payline, the player wins the car. The gaming system displays this outcome to the player. If the randomly selected reel stop positions do not correspond to the five star winning symbol combination on the payline, then in one embodiment, the gaming system evaluates the value N to determinate if the player wins the car via the second determination. If N equals a designated number, then the gaming system overrides the originally selected reel stop positions and displays the player the 5 star symbol combination and informs the player they win the car.

It should be appreciated that the above-example can be altered to vary the probability of winning the second determination based on a player's wager and provide players a better chance of winning when they wager more while still covering the cost of the designated award. For example, if a player may wager $1 or $2 and if the player wagers $2 has a greater chance of winning the car as the $1 player because the car is funded in 1/5,000,000 games. Using the above example, the second probability of winning the second determination for a player with a $2 wager is 1/6,295,337 or (1/24,300,000)+(1/6,295,337)−(1/24,300,000)×(1/6,295,337)=(1/5,000,000). Therefore, if a player wagers $1, the gaming system would randomly determine a value N from 1 and 16,993,006 inclusively for the second determination. If a player wagers $2, the gaming system would randomly determine a value N from 1 and 6,295,337 inclusively for the second determination, increasing the odds of the player winning the second determination.

Again using the above example, the present disclosure enables the value of the designated award to change and can change the probability of winning the second determination based on the amount needed to fund the designated award. If the bet size and contribution remain the same, if a player wagers $1 for a designated award of $200,000 the odds of winning would need to be 1 in 20,000,000 to fund the $200,000 award. The odds of winning the second determination would need to be 1 in 113,023,251 to fund the $200,000 award because (1/24,300,000)+(1/113,023,251)−(1/24,300,000)×(1/113,023,251)=(1/20,000,000). If a player wagers $2 for a designated award of $200,000, while maintaining the same contribution, the odds would be 1 in 10,000,000 to fund the $200,000 award. The odds of winning the second determination would need to be 1 in 16,993,006 because (1/24,300,000)+(1/16,993,006)−(1/24,300,000)×(1/16,993,006)=(1/10,000,000).

The above examples are just illustrations of how a gaming system may change an equation to account for the cost of an award while still encouraging players to wager more. It should be appreciated that in different embodiments, the player is unaware of the second determination being made and is unaware of a second determination overriding a first determination. That is, players, regardless of their wager amount, play the same game, however, in different embodiments certain players have increased odds of winning. In one embodiment, the first determination and the second determination can result in awarding a designated award, such as progressive or physical award. In another embodiment, the first determination, the second determination and a bonus game determination can result in awarding of a designated award. The probability of winning the designated award from each of the determinations may be divided in any suitable manner. For example, each of the determinations may have equal odds of obtaining a winning result. In another example, one or more of the determinations has a higher probability of obtaining a winning result. In another embodiment, only the second determination can result in award of a designated award.

In one embodiment, a single processor or controller determines the game outcome and a different processor or controller determines a second game outcome or a designated award outcome. In one such embodiment, both of the processors are located in the gaming machine. In another embodiment, one or more of the processors or controllers are located remotely from the gaming machine.

In another embodiment, the gaming system, based on the player's wager, enables the player to win one or more awards not available in the paytable of the game. For example, a first determination enables the player to win an award based on the paytable and a second determination enables the player to win a separate and distinct award. The second determination may be based on any suitable factor including but not limited to a wager amount, an average wager amount, a time of day, the award or prize, a player card status, a number of games played, or a location of the gaming machine.

It should be appreciated that the gaming system may maintain the average expected payback percentage of a gaming system while offering varying odds of winning a play of a game based on a wager amount. For example, in one embodiment, the probability of winning one or more designated awards or a game outcome based on the paytable is a constant probability. That is, the gaming system provides the player the same odds of winning a designated award as an outcome of the game, such as 1 in 200,000 chance of winning the designated award using the paytable. In one embodiment, the gaming system changes the average expected payback based on one or more separate and independent determinations of winning that designated award. For example, if the player's wager qualifies them for a 4 in 200,000 chance to win the designated award, the gaming system makes the first determination that has a 1 in 200,000 chance of winning the designated award. For the second determination, the gaming system determines whether the player wins the designated award based on a 3 in 200,000 chance of winning the designated award. Therefore, the combined probability that the player wins the designated award is 4 in 200,000. This math model readily adapts to gaming machines of different denominations and to different wager amounts facilitating the probability of winning a designated award. The average expected payback percentage remains constant when the odds increase incrementally with the wager. For example, for each credit over a certain level, the gaming system provides a player a same probability of winning a second determination.

In another embodiment, if the player wagers under a certain wager amount, the gaming system does not change the overall probability of a player obtaining a winning game outcome for a play of the game. The gaming system may provide the player any suitable probability of a player obtaining a winning game outcome for a play of the game based on any suitable factors including but not limited to a wager amount, an average wager amount, a time of day, the award or prize, a player card status, a number of games played, or a location of the gaming machine.

In an alternative embodiment, it should be appreciated that the average expected payback percentage may increase with the wager in any suitable manner. In one embodiment, the average expected payback percentage increases proportionally with the wager amount. In one embodiment, the average expected payback percentage increases faster than the wager amount. In another embodiment, the average expected payback percentage increases slower than the wager. That is, in one embodiment, the average expected payback percentage does not incrementally increase or decrease as the wager incrementally increases or decreases, therefore varying the average expected payback percentage.

In another embodiment, if the player wagers under a certain wager amount, the gaming system does not change the overall average expected payback percentage. The gaming system may provide the player any suitable average expected payback percentage based on any suitable factors including but not limited to a wager amount, an average wager amount, a time of day, the award or prize, a player card status, a number of games played, or a location of the gaming machine.

It should be appreciated that one or more probabilities of winning a designated award may increase with the wager in any suitable manner. In one embodiment, the probabilities increase linearly with the wager amount. In one embodiment, as a player wagers more, with each credit over a certain amount, the player incrementally increases the player's probability of obtaining a winning game outcome in a play of the game. In one embodiment, the probabilities increase faster than the wager. In another embodiment, the probabilities increase slower than the wager. That is, in one embodiment, the probabilities do not incrementally increase or decrease as the wager incrementally increases or decreases. In another embodiment, if the player wagers under a certain wager amount, the gaming system does not provide a possibility of winning a designated award. The gaming system may provide the player any suitable numbers of determinations to win the designated award based on the amount of the wager.

It should be appreciated that the gaming system may make the random determinations in any suitable manner. In one embodiment, the gaming system simultaneously makes multiple independent random determinations. In one embodiment, the gaming system sequentially makes multiple independent random determinations. It should also be appreciated that the random determinations may be made based on any suitable type of determination. For example, the first determination may be based on a slot type determination and the second determination may be based on a poker type determination. It should be appreciate that the determinations may be based on the same types of determinations or different types of determinations. It should also be appreciated that each determination may include a series of determinations. For example, a first slot type determination may include three independent random determinations and a second independent slot type determination may include five independent random determinations.

It should be appreciated that the gaming system may include any suitable number and type of awards that are available as a result of a separate or independent determination. These awards in different embodiments may also be included on the paytable. These awards may be any suitable award. In one embodiment, the designated award is a progressive award. In another embodiment, the designated award is an extra monetary award. In another embodiment, the designated award is a physical prize, such as a vehicle. In another embodiment, the designated award is a monetary award paid in marketing dollars funded by the gaming establishment for promotions. In another embodiment, the designated award is gaming establishment money or promotional money. That is, the player receives a certain amount of money that may only be spent at the gaming establishment or at affiliates of the gaming establishment. In one embodiment, instead of cash, the designated award is a gift certificate for a certain amount of money to be played at the gaming establishment. In one embodiment, the player may use the gaming establishment money at other venues, such as hotels and restaurants, affiliated with the gaming establishment.

In different embodiments, the gaming system of the present disclosure may be available to a player over the internet. In this embodiment, a player logs onto a dedicated gaming site. At this gaming site, the central server (i.e., the internet/intranet server) enables the player to wager on and participate in one or more on-line games. In one embodiment, based on the player's wager, at least two separate processor's or servers make separate or independent random determinations for the player as described above. In one embodiment, the game processor makes separate random determinations for the player as described above.

In one embodiment, to regulate and monitor the play of games over the internet, player's identifications are verified through credit card authentication. Through this authentication, the gaming system verifies the player, the player's age, the player's location and any other suitable information associated with the player. In one such embodiment, the gaming system utilizes the verified location information to monitor and ensure that the player in a certain location follows any applicable gaming regulations associated with that location. In another such embodiment, the gaming system utilizes the verified location information to set up different accumulated wager pools for different regions. In this embodiment, different bonus awards are allotted per region.

In another embodiment including game play over the internet, the gaming system stores information about one or more players. In this embodiment, after a player has enrolled or identified themselves with the gaming system (via the dedicated gaming site), the gaming system stores their information, such as credit card information, preferred options, player number, name, or any other information in a database. In one such embodiment, the gaming system enables the player to set and store one or more gaming options, such as jackpot betting, side wagering, and preferred games, associated with the dedicated gaming site.

In one embodiment, if a player is playing a game and the wager qualifies them for an extra separate random determination and logs out of the dedicated gaming site before the gaming system makes the extra separate random determination, the gaming system stores the player's contributed wagers for the next time the player logs onto the dedicated gaming site. Such a configuration ensures that the player is provided a chance to increase the player's odds of winning a separate random determination based on their previous contributions, even after they have left active status at the dedicated gaming site.

It should be appreciated that the expansion in the number of computers and number and speed of internet connections in recent years increases opportunities for players to play from an ever-increasing number of remote sites. Accordingly, in one embodiment, a plurality of dedicated remote gaming sites are linked together. In this embodiment, one or more of the players wagering on and playing the online games at one or more of the remote gaming sites may increase their odds of obtaining a winning game outcome in a play of the game as described above. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

It should be appreciated that any of the embodiments may be employed during a primary game or one or more bonus games of a gaming system.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one input device;

at least one display device;

at least one processor; and at least one memory device storing a plurality of instructions which, when executed by the at least one processor, cause the at least one processor to operate with the at least one display device and the at least one input device to:

(a) upon placement of a wager, provide a play of a game;

(b) determine if an amount of said wager is above a first threshold amount; and (c) if the wager amount is above the first threshold amount:

(i) determine a first game outcome by making at least one first random determination;

(ii) determine a second game outcome by making at least one second random determination;

(iii) determine if at least one of the determined first game outcome and the determined second game outcome is a designated game outcome;

(iv) if at least one of the determined first game outcome and the determined second game outcome is the designated game outcome, display the designated game outcome;

(v) if neither of the determined first game outcome and the determined second game outcome is the designated game outcome, display a game outcome corresponding to at least one of the determined first game outcome and the determined second game outcome; and (vi) determine and display an indication of any award associated with the displayed game outcome.

2. The gaming system of claim 1, wherein the plurality of instructions, when executed by the at least one processor, cause the at least one processor to operate with the at least one display device to, if the wager amount is below the first threshold amount:

(i) determine the first game outcome by making the at least one first random determination;

(ii) display the determined first game outcome; and (iii) determine and display an indication of any award associated with the displayed determined first game outcome.

3. The gaming system of claim 1, wherein the at least one first random determination includes a plurality of random determinations.

4. The gaming system of claim 1, wherein the at least one second random determination includes a plurality of random determinations.

5. The gaming system of claim 1, wherein at least one award is selected from the group consisting of a jackpot award, a progressive award, and a physical award.

6. The gaming system of claim 1, wherein the at least one processor includes a first processor and a second processor, and the first processor makes at least one of the at least one first random determination.

7. The gaming system of claim 6, wherein the gaming system includes a housing, and at least one of the first processor and the second processor resides in the housing.

8. The gaming system of claim 1, wherein a probability of the second game outcome being the designated game outcome is higher than a probability of the first game outcome being the designated game outcome.

9. The gaming system of claim 1, wherein the determination of the first game outcome is also based on a first paytable.

10. The gaming system of claim 1, wherein the determination of the second game outcome is also based on a second paytable.

11. The gaming system of claim 1, wherein the plurality of instructions, when executed by the at least one processor, cause the at least one processor to operate with the at least one display device to:

(d) determine if the wager amount is above a second threshold amount;

(e) if the wager amount is below the second threshold amount and above the first threshold amount, repeat (c); and (f) if the wager amount is above the second threshold amount:

(i) determine the first game outcome by making the at least one first random determination;

(ii) determine the second game outcome by making the at least one second random determination;

(iii) determine a third game outcome by making at least one third random determination;

(iv) determine if any of the determined first game outcome, the determined second game outcome, and the determined third game outcome is the designated game outcome;

(v) if at least one of the determined first game outcome, the determined second game outcome, and the determined third outcome is the designated game outcome, display the designated game outcome;

(vi) if none of the determined first game outcome, the determined second game outcome, and the determined third game outcome is the designated game outcome, display a game outcome corresponding to at least one of the determined first game outcome, the determined second game outcome, and the determined third game outcome; and (vii) determine and display an indication of any award associated with the displayed game outcome.

12. The gaming system of claim 11, wherein a probability of the third game outcome being the designated game outcome is higher than a probability of the second game outcome being the designated game outcome.

13. The gaming system of claim 11, wherein the second threshold amount is greater than the first threshold amount.

14. The gaming system of claim 1, wherein a number of random determinations of the at least one second random determination is greater than a number of random determinations of the at least one first random determination.

15. The gaming system of claim 1, wherein a probability of the second game outcome being the designated game outcome is based, at least in part, on the wager amount.

16. The gaming system of claim 1, wherein the first threshold amount defines an upper limit of a wager range.

17. A method of operating a gaming system, said method comprising:

causing at least one processor to execute a plurality of instructions stored in at least one memory device to:

(a) upon placement of a wager, provide a play of a game;

(b) determine if an amount of said wager is above a first threshold amount; and (c) if the wager amount is above the first threshold amount:

(i) determine a first game outcome by making at least one first random determination;

(ii) determine a second game outcome by making at least one second random determination;

(iii) determine if at least one of the determined first game outcome and the determined second game outcome is a designated game outcome;

(iv) if at least one of the determined first game outcome and the determined second game outcome is the designated game outcome, operate with at least one display device to display the designated game outcome;

(v) if neither of the determined first game outcome and the determined second game outcome is the designated game outcome, operate with the at least one display device to display a game outcome corresponding to at least one of the determined first game outcome and the determined second game outcome; and (vi) determine and operate with the at least one display device to display an indication of any award associated with the displayed game outcome.

18. The method of claim 17, which includes causing the at least one processor to execute the plurality of instructions to, if the wager amount is below the first threshold amount:

(i) determine the first game outcome by making the at least one first random determination;

(ii) operate with the at least one display device to display the determined first game outcome; and (iii) determine and operate with the at least one display device to display an indication of any award associated with the displayed determined first game outcome.

19. The method of claim 17, wherein the at least one first random determination includes a plurality of random determinations.

20. The method of claim 17, wherein the at least one second random determination includes a plurality of random determinations.

21. The method of claim 17, wherein at least one award is selected from the group consisting of a jackpot award, a progressive award, and a physical award.

22. The method of claim 17, wherein the at least one processor includes a first processor and a second processor, and the first processor makes at least one of the at least one first random determination.

23. The method of claim 22, wherein the gaming system includes a housing, and at least one of the first processor and the second processor resides in the housing.

24. The method of claim 17, wherein a probability of the second game outcome being the designated game outcome is higher than a probability of the first game outcome being the designated game outcome.

25. The method of claim 17, wherein the determination of the first game outcome is also based on a first paytable.

26. The method of claim 17, wherein the determination of the second game outcome is also based on a second paytable.

27. The method of claim 17, which includes:

(d) causing the at least one processor to execute the plurality of instructions to determine if the wager amount is above a second threshold amount;

(e) if the wager amount is below the second threshold amount and above the first threshold amount, repeating (c); and (f) if the wager amount is above the second threshold amount, causing the at least one processor to execute the plurality of instructions to:

(i) determine the first game outcome by making the at least one first random determination;

(ii) determine the second game outcome by making the at least one second random determination;

(iii) determine a third game outcome by making at least one third random determination;

(iv) determine if any of the determined first game outcome, the determined second game outcome, and the determined third game outcome is the designated game outcome;

(v) if at least one of the determined first game outcome, the determined second game outcome, and the determined third outcome is the designated game outcome, operate with the at least one display device to display the designated game outcome;

(vi) if none of the determined first game outcome, the determined second game outcome, and the determined third game outcome is the designated game outcome, operate with the at least one display device to display a game outcome corresponding to at least one of the determined first game outcome, the determined second game outcome, and the determined third game outcome; and (vii) determine and operate with the at least one display device to display an indication of any award associated with the displayed game outcome.

28. The method of claim 27, wherein a probability of the third game outcome being the designated game outcome is higher than a probability of the second game outcome being the designated game outcome.

29. The method of claim 27, wherein the second threshold amount is greater than the first threshold amount.

30. The method of claim 17, wherein a number of random determinations of the at least one second random determination is greater than a number of random determinations of the at least one first random determination.

31. The method of claim 17, wherein a probability of the second game outcome being the designated game outcome is based, at least in part, on the wager amount.

32. The method of claim 17, wherein the first threshold amount defines an upper limit of a wager range.

33. The method of claim 17, which is provided through a data network.

34. The method of claim 33, wherein the data network is an internet.

* * * * *